US008469210B2

(12) United States Patent
MacBain et al.

(10) Patent No.: US 8,469,210 B2
(45) Date of Patent: Jun. 25, 2013

(54) TOY CAR CONNECTION APPARATUS AND METHOD

(75) Inventors: Jamie MacBain, Chicago, IL (US); Gary Aigner, E. Greenwich, RI (US); Joe Chan, Fanling (HK); Michael Lichodziejewski, Chicago, IL (US); Joseph Gheith, North Aurora, IL (US)

(73) Assignee: Learning Curve Brands, Inc., Dyersville, IA (US)

( * ) Notice: Subject to any disclaimer, the term of this patent is extended or adjusted under 35 U.S.C. 154(b) by 0 days.

(21) Appl. No.: 13/308,763

(22) Filed: Dec. 1, 2011

(65) Prior Publication Data

US 2012/0199040 A1 Aug. 9, 2012

Related U.S. Application Data

(63) Continuation of application No. PCT/US2010/036935, filed on Jun. 1, 2010.

(60) Provisional application No. 61/183,041, filed on Jun. 1, 2009.

(51) Int. Cl.
*A63H 19/18* (2006.01)

(52) U.S. Cl.
USPC ..... 213/75 TC; 213/75 R; 446/444

(58) Field of Classification Search
USPC ..... 105/238.1, 238.2; 446/444; 213/75 TC, 213/75 R
See application file for complete search history.

(56) References Cited

U.S. PATENT DOCUMENTS

| | | | | |
|---|---|---|---|---|
| 1,582,344 | A | | 4/1926 | Nattrass |
| 2,595,936 | A | | 5/1952 | Goode, Jr. |
| 3,199,371 | A | | 8/1965 | Lins et al. |
| 3,468,169 | A | * | 9/1969 | Welch ..... 74/2 |
| 3,469,713 | A | * | 9/1969 | Edwards et al. ..... 213/75 TC |
| 4,522,607 | A | * | 6/1985 | Kilroy et al. ..... 446/447 |
| 4,544,094 | A | | 10/1985 | Scholey |
| 4,617,001 | A | * | 10/1986 | Parein ..... 446/102 |
| 4,698,044 | A | | 10/1987 | Kennedy et al. |
| 4,771,943 | A | | 9/1988 | Cooney et al. |
| 4,898,326 | A | | 2/1990 | Edwards et al. |
| 4,940,442 | A | * | 7/1990 | Matsuda ..... 446/90 |
| 4,953,785 | A | | 9/1990 | Keska |
| 4,997,187 | A | | 3/1991 | Smollar et al. |

(Continued)

FOREIGN PATENT DOCUMENTS

| | | |
|---|---|---|
| JP | 09-253343 | 9/1997 |
| JP | 10-099555 | 4/1998 |

OTHER PUBLICATIONS

International Search Report and Written Opinion for PCT/US2010/036935 dated Feb. 1, 2011.

*Primary Examiner* — Jason C Smith
(74) *Attorney, Agent, or Firm* — Michael Best & Friedrich LLP

(57) ABSTRACT

A toy train car including a coupler or hitch. The coupler includes a first connector (e.g., socket) configured to be connected to the train car and a second connector (e.g., ball) configured to be connected to the train car. The first connector can be positioned in the front or rear of the train car. The second connector also can be positioned in the front or rear of the train car. Each train car can include a first connector and a second connector. The first and second connectors are configured to couple together to link a plurality of train cars together.

17 Claims, 20 Drawing Sheets

U.S. PATENT DOCUMENTS 5,074,465 A 12/1991 Nepper
5,405,080 A 4/1995 Yeung et al.
5,454,513 A 10/1995 Wilson
5,503,330 A 4/1996 Riley
5,529,241 A 6/1996 Roder
5,579,997 A 12/1996 Jackson et al.
5,617,996 A 4/1997 Julve
5,657,695 A 8/1997 Lanoix et al.
5,681,202 A 10/1997 Sander
5,690,278 A 11/1997 Grubb
5,769,681 A * 6/1998 Greenwood et al. ..... 446/120
5,791,253 A 8/1998 Schultheis et al.
6,019,289 A 2/2000 Sung
6,093,079 A 7/2000 House
6,155,177 A 12/2000 Backfisch
6,264,522 B1 * 7/2001 Dickson ..... 446/120
6,299,072 B1 10/2001 Burns
6,308,845 B1 * 10/2001 Sergent, IV ..... 213/75 TC
6,328,500 B1 12/2001 Rubio
6,382,519 B1 5/2002 Choi
6,398,120 B1 6/2002 Klein
6,398,121 B1 6/2002 Morgan
6,427,926 B1 8/2002 Lai
6,475,060 B1 11/2002 Liu
6,517,007 B2 2/2003 Kong
6,601,774 B1 8/2003 Kasimoff
6,631,850 B1 * 10/2003 Wa ..... 238/10 F
6,648,237 B2 11/2003 Rothkopf et al.
6,695,219 B1 2/2004 Fowler, Sr. et al.
6,722,941 B2 4/2004 Dowd et al.
6,796,509 B1 9/2004 Webster et al.
6,883,719 B2 4/2005 Pyrce
6,935,574 B2 8/2005 Cheng
6,948,998 B2 * 9/2005 Bagley ..... 446/124
6,951,307 B2 10/2005 Lin
6,974,086 B2 12/2005 Cheng
7,051,948 B2 5/2006 Wa
7,083,111 B2 8/2006 Reisher et al.
7,182,024 B2 2/2007 Pfeiffer
D551,304 S * 9/2007 Manvelian ..... D21/484
7,293,671 B2 11/2007 Senften
7,309,023 B2 12/2007 Kaiser
7,320,435 B2 1/2008 Webster et al.
7,354,006 B1 4/2008 Bricker
7,354,330 B2 * 4/2008 Bentley, Jr. ..... 446/102
7,383,962 B2 6/2008 Webster et al.
7,597,049 B2 * 10/2009 Leonowicz ..... 105/1.5
8,152,007 B2 * 4/2012 Ito et al. ..... 213/75 TC
2006/0054582 A1 * 3/2006 Webster et al. ..... 213/75 TC
2009/0014402 A1 * 1/2009 Wolf et al. ..... 213/75 TC
2009/0139424 A1 6/2009 Norman et al.
2011/0036800 A1 * 2/2011 Ito et al. ..... 213/75 TC
2011/0253664 A1 * 10/2011 Grubba ..... 213/75 TC
2012/0199040 A1 * 8/2012 MacBain et al. ..... 105/238.2

* cited by examiner

TOY CAR CONNECTION APPARATUS AND METHOD

RELATED APPLICATIONS

This application is a continuation of International Patent Application No. PCT/US2010/036935, filed on Jun. 1, 2010, which is a non-provisional application of and claims priority to U.S. Provisional Patent Application No. 61/183,041, filed on Jun. 1, 2009. The contents of International Patent Application No. PCT/US2010/036935 and U.S. Provisional Patent Application No. 61/183,041 are incorporated herein by reference.

BACKGROUND

Couplers for toy railroad cars are used to connect cars to one another to form a train. A coupler can couple one car to one or two additional cars.

SUMMARY

The invention relates to a toy car coupler having a single piece design that uses the elastic/flexible properties of the molded plastic material to accommodate coupling and decoupling. The coupler is similar to a ball-and-socket type connector.

In one construction, the coupler includes a fixed male connector in the front of the toy car and a fixed female connector in the rear of the toy car. The female connector includes notches on the top and the bottom to accommodate a vertical pivoting action in a coupled toy car.

In another construction, the coupler includes a fixed male connector in the front of the car and a female connector in the rear of the car that can pivot horizontally to accommodate horizontal pivoting in a coupled toy car. The female connector includes cutouts on the top and the bottom to accommodate a vertical pivoting action in a coupled toy car.

In yet another construction, the coupler includes a fixed male connector in the front of the car and a female connector in the rear of the car that is connected to an internal ball joint fixed to a coiled tension-type spring. The ball joint allows for a full range of motion on a coupled toy car. The spring returns the coupler to a "neutral" position when not under any force. The female connector includes notches on the top and the bottom to accommodate additional vertical pivoting action in a coupled toy car.

In another construction, the coupler includes a fixed male connector in the front of the car and a female connector in the rear of the car that is connected to a ball joint. The ball joint includes a rod extending therefrom which is molded in one piece from the same type of material.

In yet another construction, the coupler includes a fixed male connector in the front of the car and a female connector in the rear of the car that is connected to an internal ball joint. The ball joint includes a rod extending therefrom which is molded in one piece from the same type of material. This construction includes a captured ring to prevent the coupler from spinning and maintains the notches in the coupler vertically aligned.

In a further construction, the coupler includes a fixed male connector in the front of the car and a female connector in the rear of the car that is connected to an internal ball joint. The ball joint includes a rod extending therefrom which is molded in one piece from the same type of material. This construction does not include the captured ring, but the end is pinched during the assembly process to maintain the notches in the coupler vertically aligned.

The invention also relates to a toy car coupler system that allows for the maximum range of motion without binding or decoupling of one or more of the cars. The coupler system allows a train of toy cars to perform at high speeds under various track conditions, such as loops, ascents, descents, curves (both flat and banked), etc. In one construction, the coupler system is able to withstand a minimum linear force of the weight of at least six toy cars when held vertically without support.

In one embodiment, the invention provides a train car comprising a main base, a first connector, a second connector, and a body. The main base includes a floor including a first end and a second end opposite the first end, a wall extending substantially perpendicular from the floor and around a periphery of the floor, a first gap in the wall at the first end, a second gap in the wall at the second end, and a post positioned within the second gap and extending substantially perpendicular from the floor. The first connector includes a post having a first end and a second end, at least a portion of the post configured to be received within the first gap, the first end of the post configured to protrude from the wall of the base, a ball secured to the first end, a first base positioned between the first end and the second end of the post, the first base configured to be received within the first gap, the first base including a first surface positioned substantially flush with an outer surface of the wall of the base, a second base secured to the second end of the post, the second base positioned inside the wall of the base. The second connector includes a post having a first end and a second end, a hollow base secured to the first end, the hollow base configured to receive the post extending from the floor of the base, a receptacle secured to the second end, the receptacle configured to receive a ball from a complementary train car. The body includes an outer wall configured to receive the wall of the main base and configured to trap the first connector and the second connector in their respective positions.

In another embodiment, the invention provides a train car comprising a main base, a first connector positioned at the first end of the floor of the main base, and a second connector. The main base includes a floor including a first end and a second end opposite the first end, and a housing connected to the second end. The second connector includes a receptacle configured to receive the first connector of a complementary train car, a post extending from the receptacle, a ball connected to the post, the ball configured to rest within the housing, and a flexible member extending from the ball and substantially opposite to the post, the flexible member at least partially positioned within the housing and at least partially positioned within a periphery of the floor.

Other aspects of the invention will become apparent by consideration of the detailed description and accompanying drawings.

DETAILED DESCRIPTION

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways. Also, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items. Unless specified or limited otherwise, the terms "mounted," "connected," "supported," and "coupled" and variations thereof are used broadly and encompass both direct and indirect mountings, connections, supports, and couplings.

Although directional references, such as upper, lower, downward, upward, rearward, bottom, front, rear, etc., may be made herein in describing the drawings, these references are made relative to the drawings (as normally viewed) for convenience. These directions are not intended to be taken literally or limit the present invention in any form. In addition, terms such as "first," "second," and "third" are used herein for purposes of description and are not intended to indicate or imply relative importance or significance.

Figure 1:
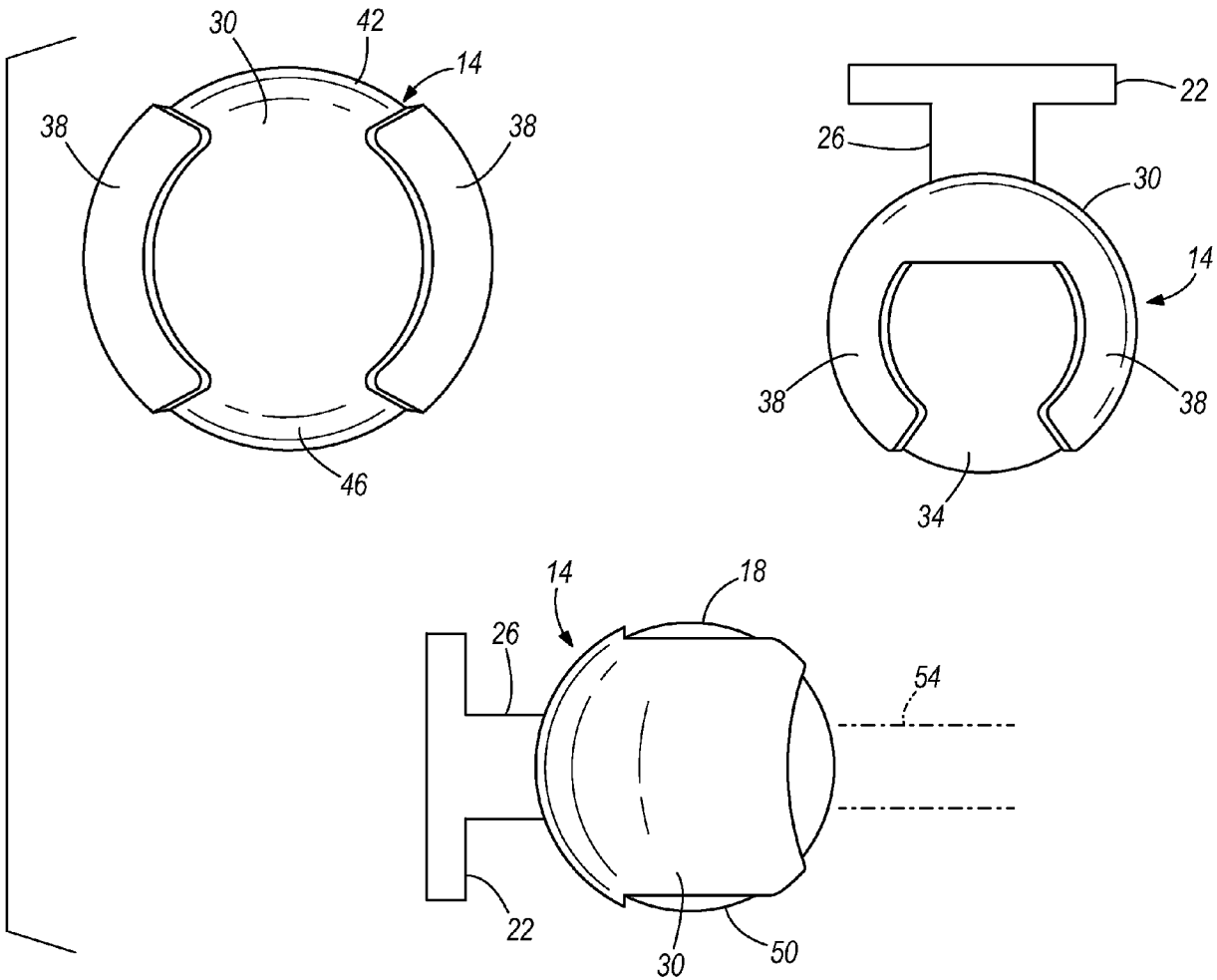
FIG. 1 illustrates a front, side, and top view of a coupler for a toy car according to an embodiment of the present invention.
Figure 2A:
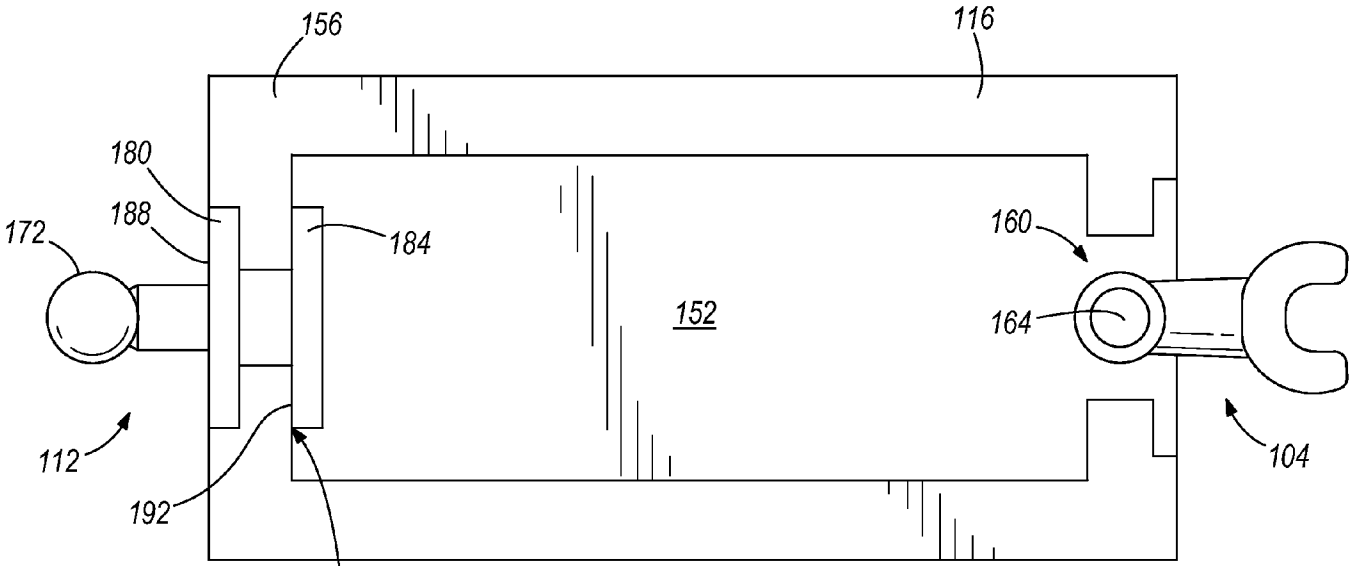
FIGS. 2A-N illustrates a plurality of views of a coupler for a toy car according to an embodiment of the present invention.
Figure 2B:
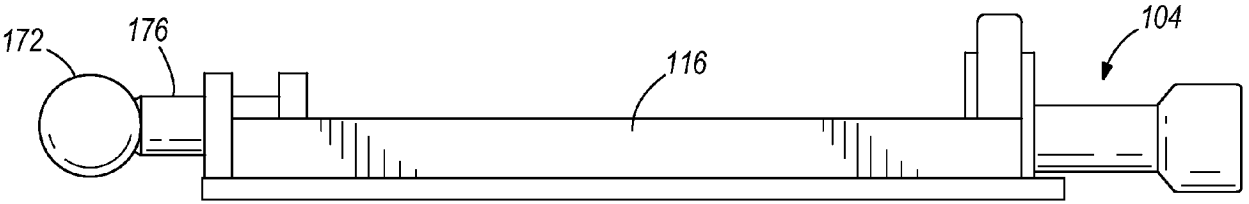
Figure 2D:
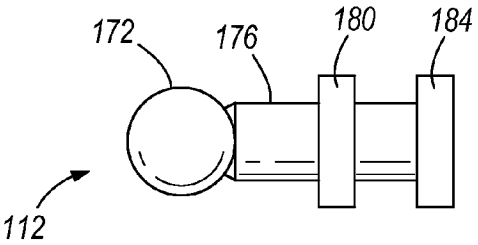
Figure 2C:
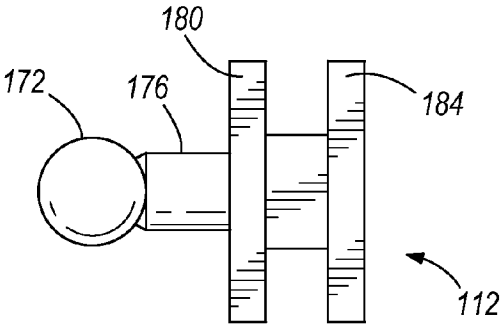
Figure 2F:
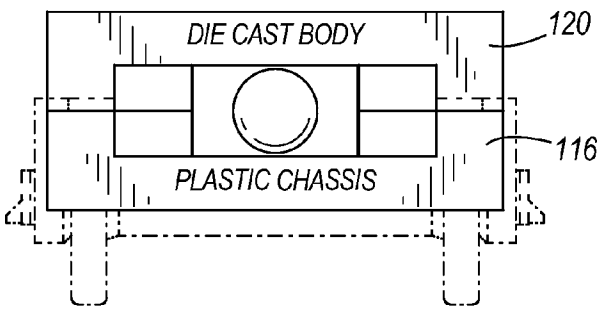
Figure 2E:
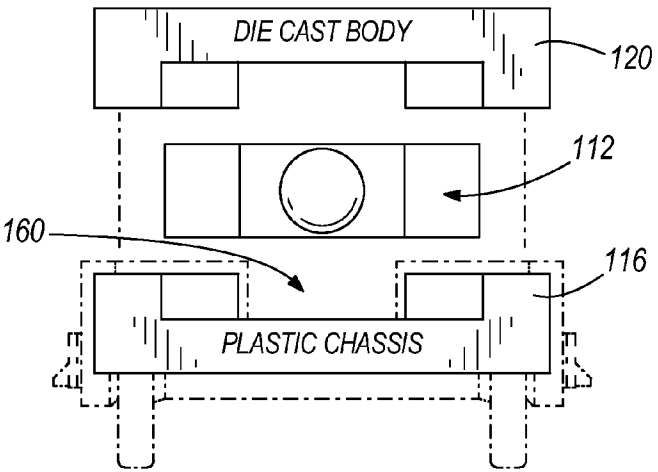
Figure 2H:
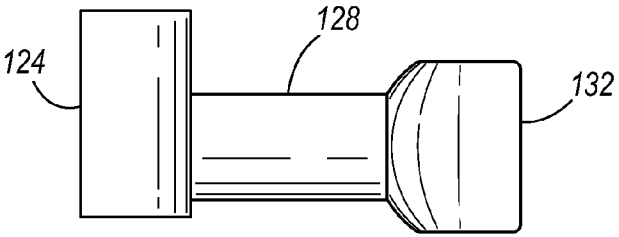
Figure 2J:
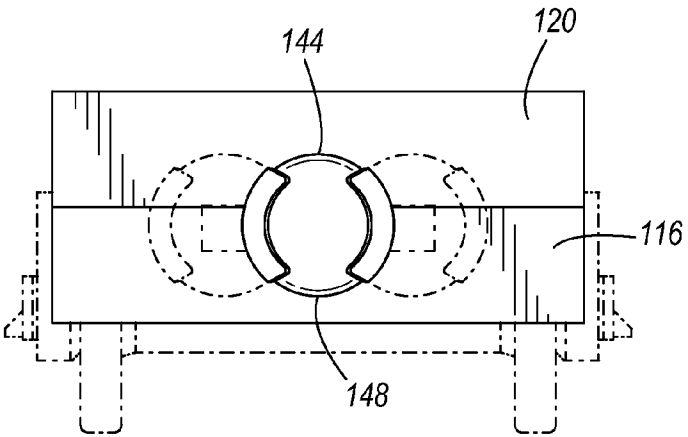
Figure 2G:
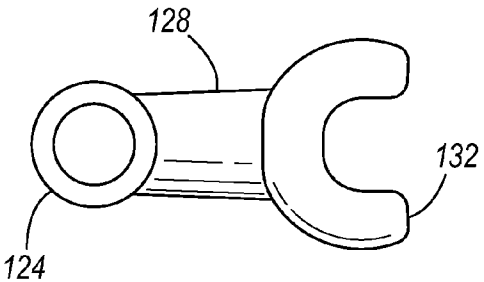
Figure 2I:
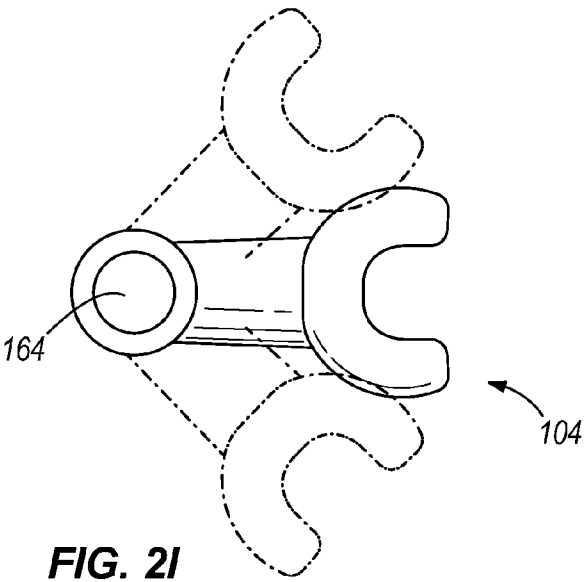
Figure 2L:
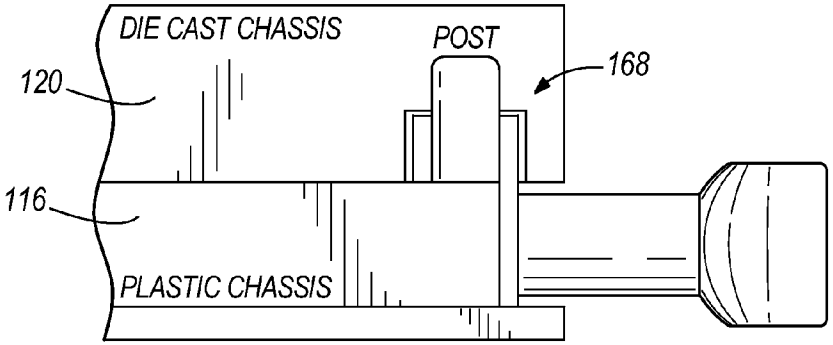
Figure 2N:
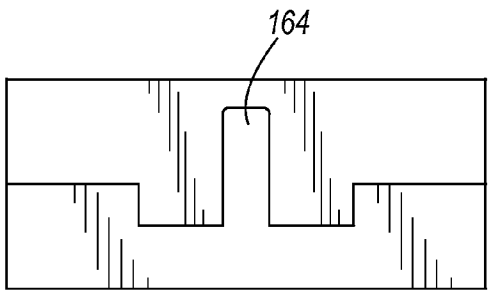
Figure 2K:
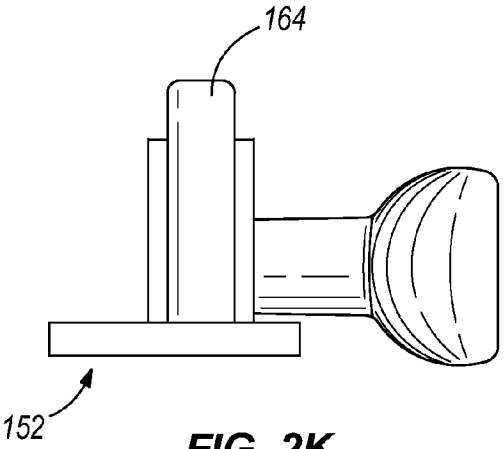
Figure 2M:
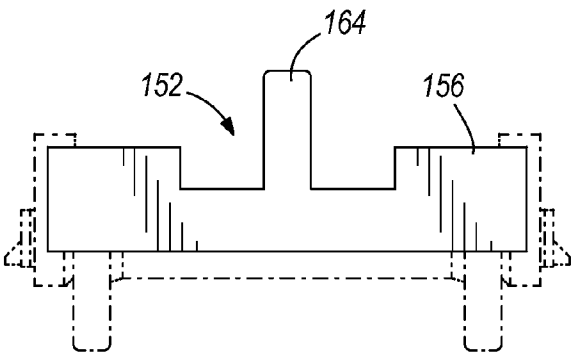
Figure 3A:
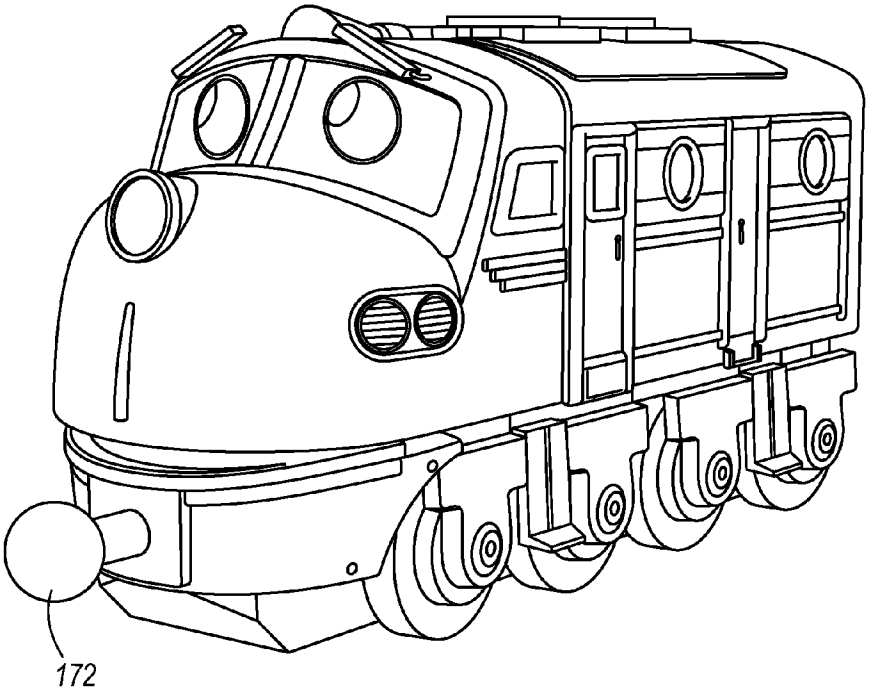
FIGS. 3A-E illustrates a plurality of views of the coupler illustrated in FIGS. 2A-N.
Figure 3B:
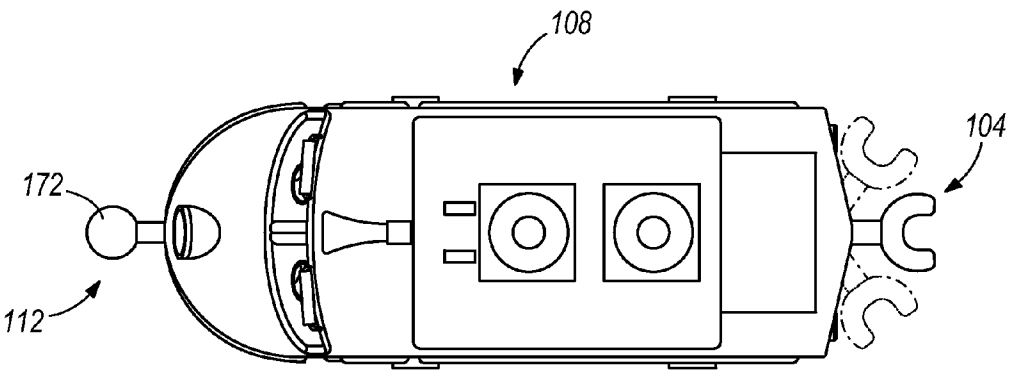
Figure 3D:
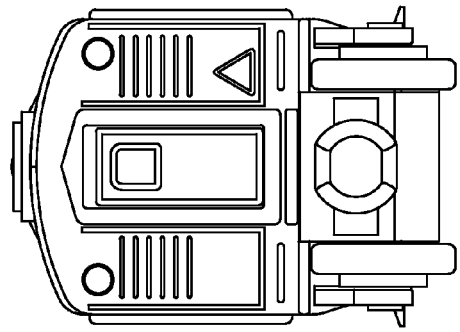
Figure 3C:
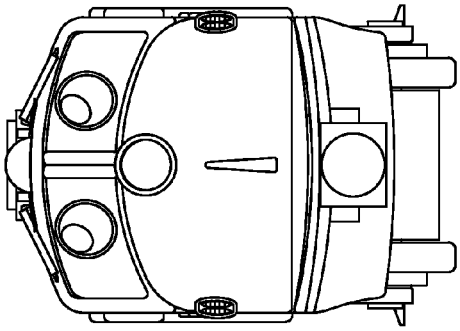
Figure 3E:
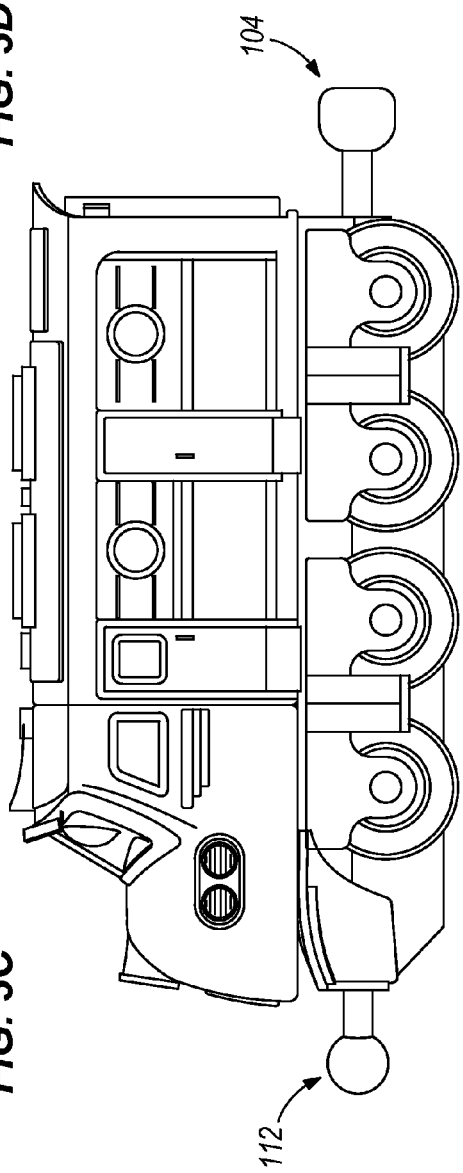
Figure 4A:
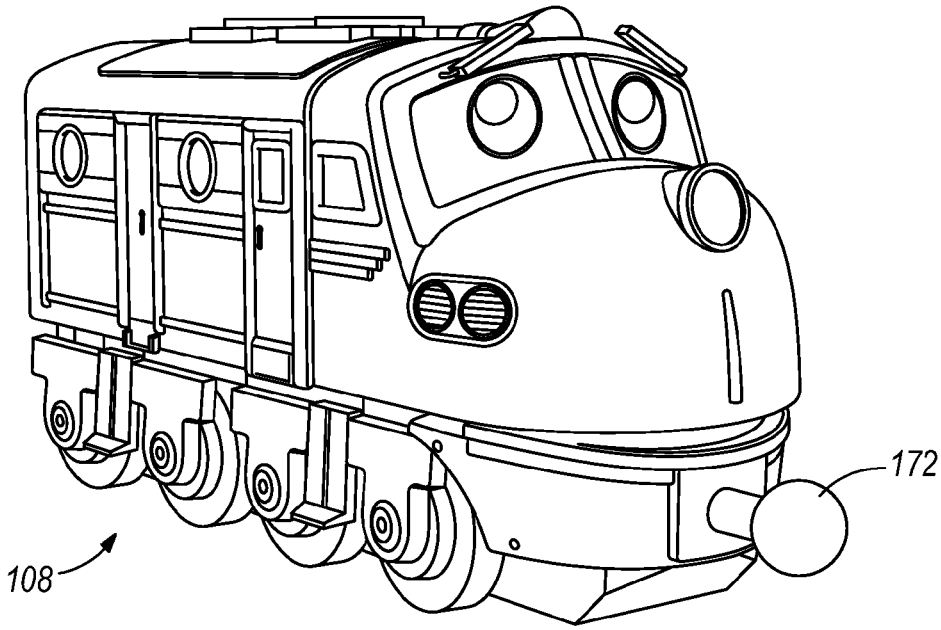
FIGS. 4A-D illustrates a plurality of views of the coupler illustrated in FIGS. 2A-N.
Figure 4B:
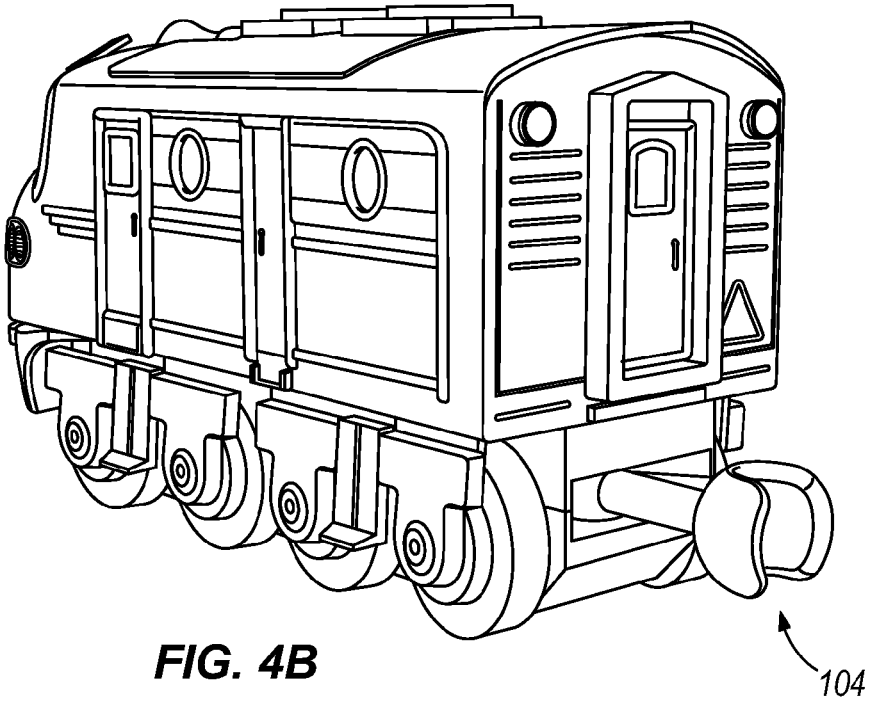
Figure 4C:
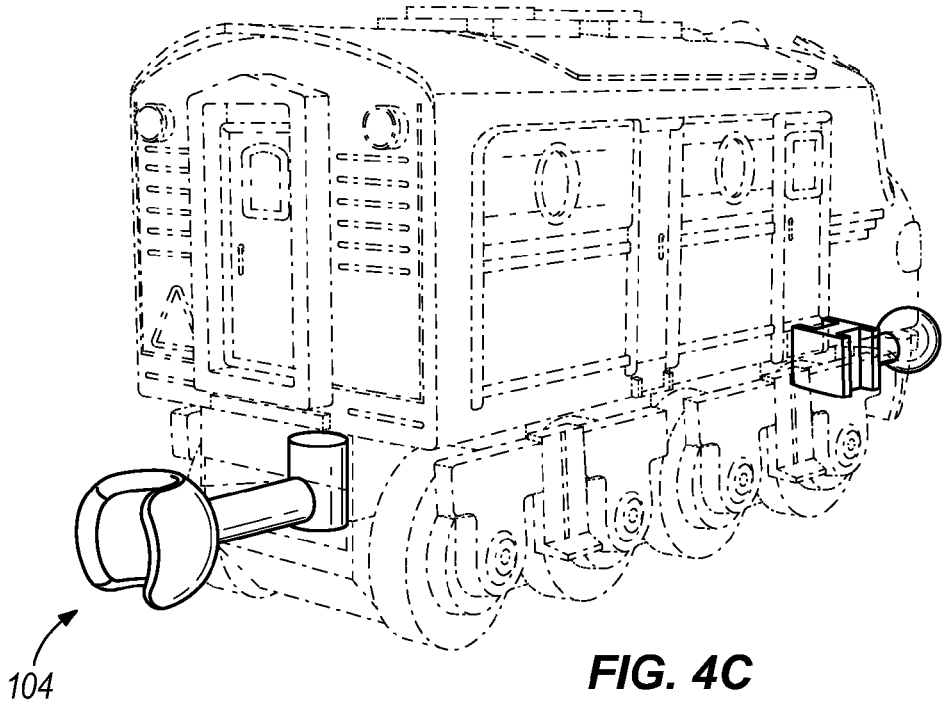
Figure 4D:
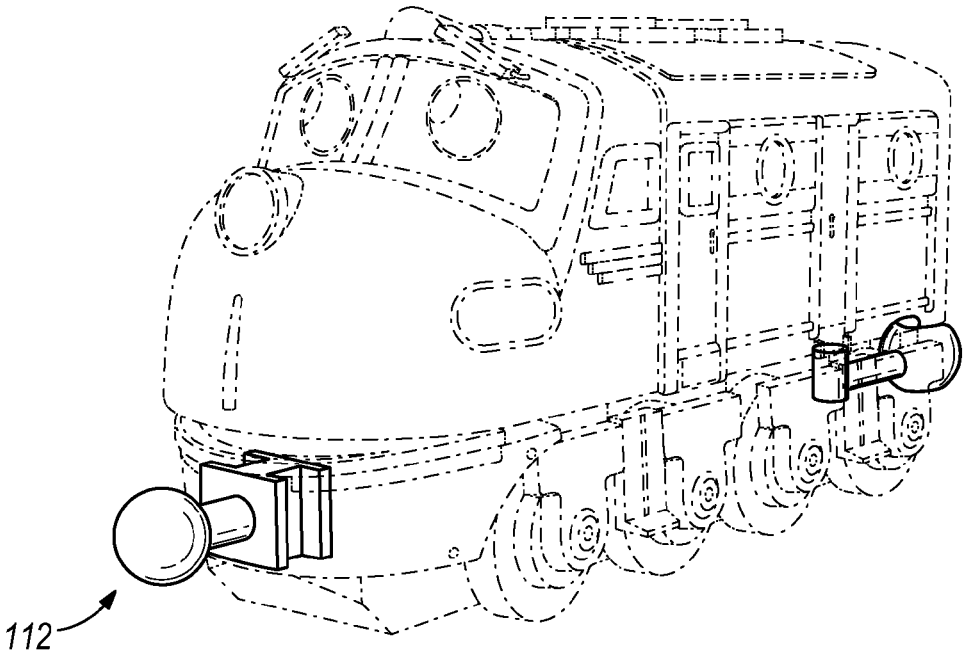

FIG. 1 illustrates a coupler 10 or hitch according to one embodiment of the present invention. The coupler 10 includes a first connector 14 (e.g., socket) configured to be connected to a car and a second connector 18 (e.g., ball) configured to be connected to the car. The first connector 14 can be positioned in the front or rear of the car. Similarly, the second connector 18 can be positioned in the front or rear of the car. Each car can include a first connector 14 and a second connector 18. The connectors 14, 18 are configured to couple together to link a plurality of cars together.

The first connector 14 includes a base 22 and a post 26 extending from the base 22. The first connector 14 also includes a receptacle 30 generally partially spherical-shaped. The receptacle 30 includes a recess 34 and a sidewall 38 configured to receive the second connector 18. The sidewall 38 includes a first notch 42 and a second notch 46 substantially aligned with the first notch 42. In one construction, the first connector 14 is molded as a single piece or component.

The second connector 18 includes a ball 50 and a post 54 extending from the ball 50. In one construction, the second connector 18 is molded as a single piece or component. The ball 50 is configured to be received within the receptacle 30 to link a first car and a second car. The ball 50 also is configured to move within the receptacle 30. As the ball 50 moves within the receptacle 30, the post 54 is configured to be received within the first notch 42 and the second notch 46 to accommodate vertical changes (e.g., hills) in the terrain that the cars traverse.

When the first connector 14 is coupled to the second connector 18, the post 26 and the post 54 are substantially aligned when the cars are on level terrain. The ball 50 of the second connector 18 pivots in the vertical direction with respect to the first connector 14 as the cars traverse hilly terrain. The coupler 10 accommodates a range of motion between about 0 degrees and about +90 degrees and between about 0 degrees and about −90 degrees (where 0 degrees is defined when the post 26 and the post 54 are substantially aligned).

FIGS. 2-4 illustrate a coupler 100 according to one embodiment of the present invention. The coupler 100 includes a first connector 104 (e.g., socket) configured to be connected to a car 108 and a second connector 112 configured to be connected to the car 108. The car 108 can include a frame 116 or base (e.g., chassis) and a body 120 configured to couple to the frame 116. The first connector 104 and/or the second connector 112 can connect to the frame 116 and/or the body 120 and/or be positioned between the frame 116 and the body 120. The first connector 104 can be positioned in the front or rear of the car 108. Similarly, the second connector 112 can be positioned in the front or rear of the car 108. Each car 108 can include a first connector 104 and a second connector 112. The connectors 104, 112 are configured to couple together to link a plurality of cars 108 together.

The first connector 104 includes a hollow base 124 having a circular cross-section and a predetermined height. The first connector 104 also includes a post 128 extending from the hollow base 124 and a receptacle 132. The post 128 includes a gradually expanding size (e.g., diameter) from a first end (e.g., the hollow base 124) to a second end (e.g., the receptacle 132). The receptacle 132 is generally partially spherical-shaped. The receptacle 132 includes a recess 136 and a sidewall 140 configured to receive the second connector 112. The sidewall 140 includes a first notch 144 and a second notch 148 substantially aligned with the first notch 144. In one construction, the first connector 104 is molded as a single piece or component.

The frame 116 of the car 108 includes a floor 152 and a wall 156 extending substantially around the perimeter of the floor 152. The wall 156 includes a gap 160 at a rear of the car 108 and the front of the car 108 to accommodate one of the connectors 104, 112. The frame 116 includes a post 164 extending substantially perpendicularly with respect to the floor 152. The post 164 includes a predetermined height and is positioned within the gap 160. The post 164 is configured to receive the hollow base 124 of the first connector 104. The body 120 of the car 108 includes a wall 168 that at least partially surrounds the wall 156 of the frame 116 when coupled to the frame 116. The wall 168 extends over the gap 160 in the wall 156 of the frame 116 to trap the first connector between the frame 116 and the body 120 of the car 108, and also prevents the hollow base 124 of the first connector 104 from falling off the post 164.

The second connector 112 includes a ball 172, a post 176 extending from the ball 172, a first base 180 and a second base 184. The first and second bases 180, 184 are configured to be received within the gap 160 in the wall 156 of the frame 116 to secure the second connector 112 to the car 108. The first base 180 is indented within the wall 156 and includes a first surface 188 generally flush with an outer surface of the wall 156. The second base 184 is positioned inside the wall 156 and includes a first surface 192 in contact with an inner surface of the wall 156. In one construction, the second connector 112 is molded as a single piece or component.

The ball 172 is configured to be received within the receptacle 132 to link a first car 108 and a second car 108. The ball 172 also is configured to move within the receptacle 132. As the ball 172 moves within the receptacle 132, the post 176 is configured to be received within the first notch 144 and the second notch 148 to accommodate vertical changes (e.g., hills, loops) between adjacent cars 108 due to the terrain that the cars traverse. Also, the first connector 104 can pivot with respect to the post 164 to accommodate horizontal changes (e.g., curves, turns) between adjacent cars 108 due to the terrain that the cars traverse.

When the first connector 104 is coupled to the second connector 112, the post 128 and the post 176 are substantially aligned when the cars 108 are on level terrain. The ball 172 of the second connector 112 pivots in the vertical direction with respect to the first connector 104 as the cars 108 traverse hilly terrain. The coupler 100 accommodates a range of motion in a vertical plane and a horizontal plane. In the vertical plane, the coupler 100 accommodates a range of motion between about 0 degrees and about +90 degrees and between about 0 degrees and about −90 degrees (where 0 degrees is defined when the post 128 and the post 176 are substantially aligned). In the horizontal plane, the coupler 100 accommodates a range of motion between about 0 degrees and about +60 degrees and between about 0 degrees and −60 degrees (where 0 degrees is defined when the post 128 and the post 176 are substantially aligned). The motion in the horizontal plane can include the pivot motion of the hollow base 124 with respect to the post 164 or the pivot motion of the ball 172 with respect to the receptacle 132 or a combination thereof.

Figure 5A:
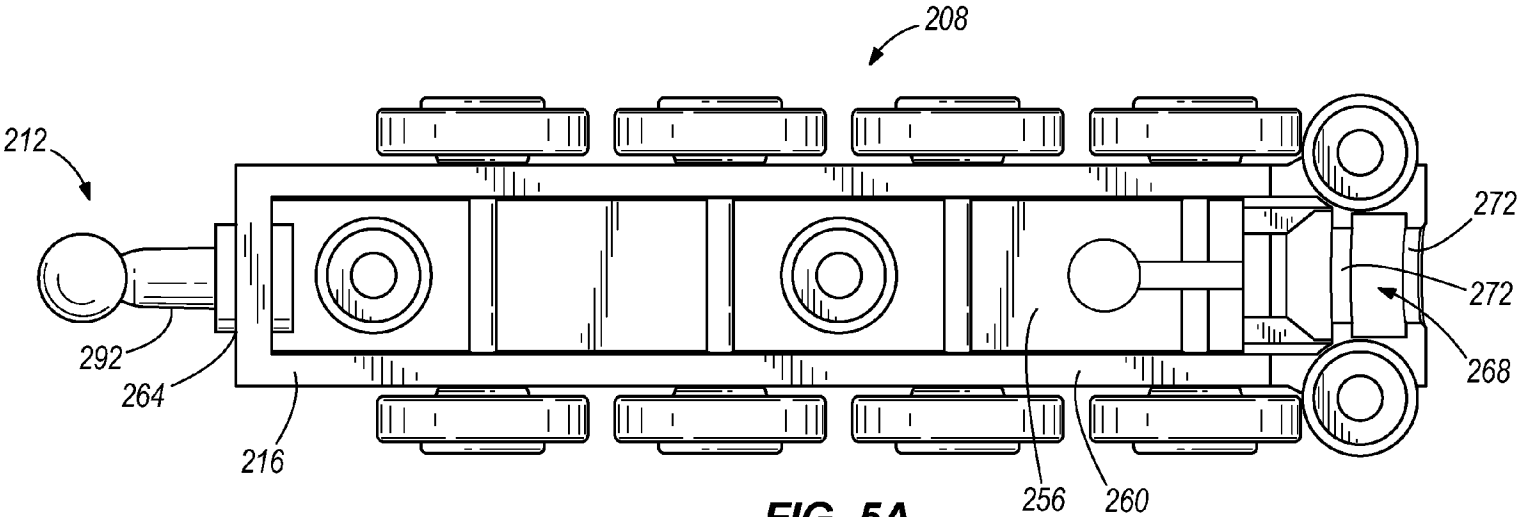
FIGS. 5A-C is a top view of a coupler for a toy car according to an embodiment of the present invention.
Figure 5C:
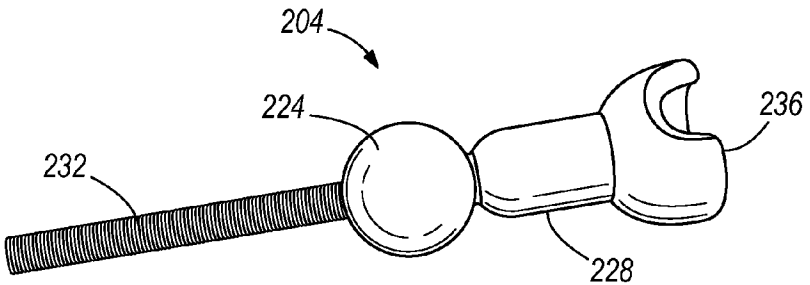
Figure 5B:
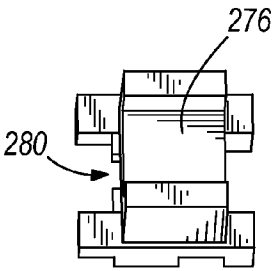
Figure 6:
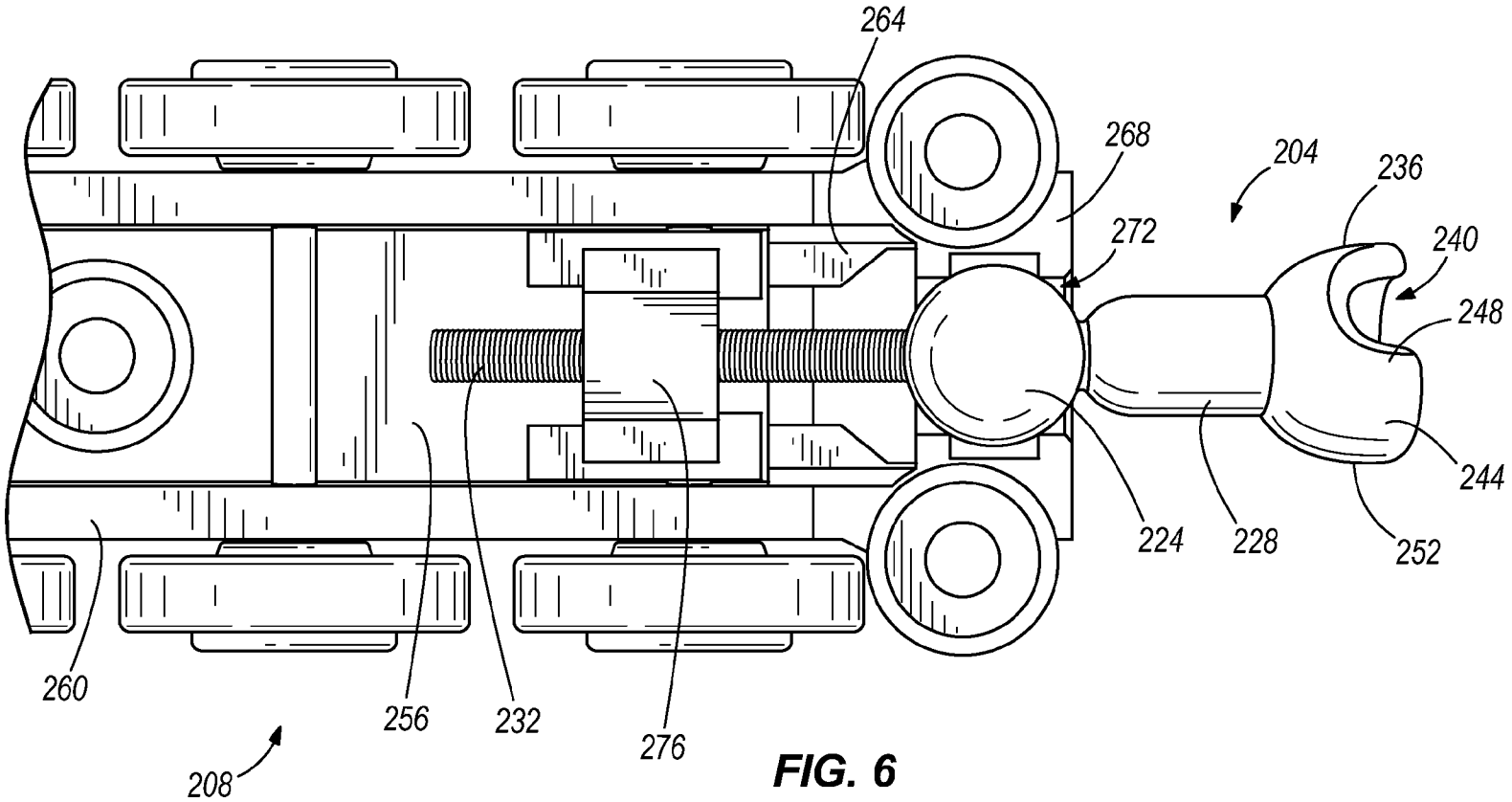
FIG. 6 is an enlarged top view of a portion of the coupler illustrated in FIGS. 5A-C.
Figure 7:
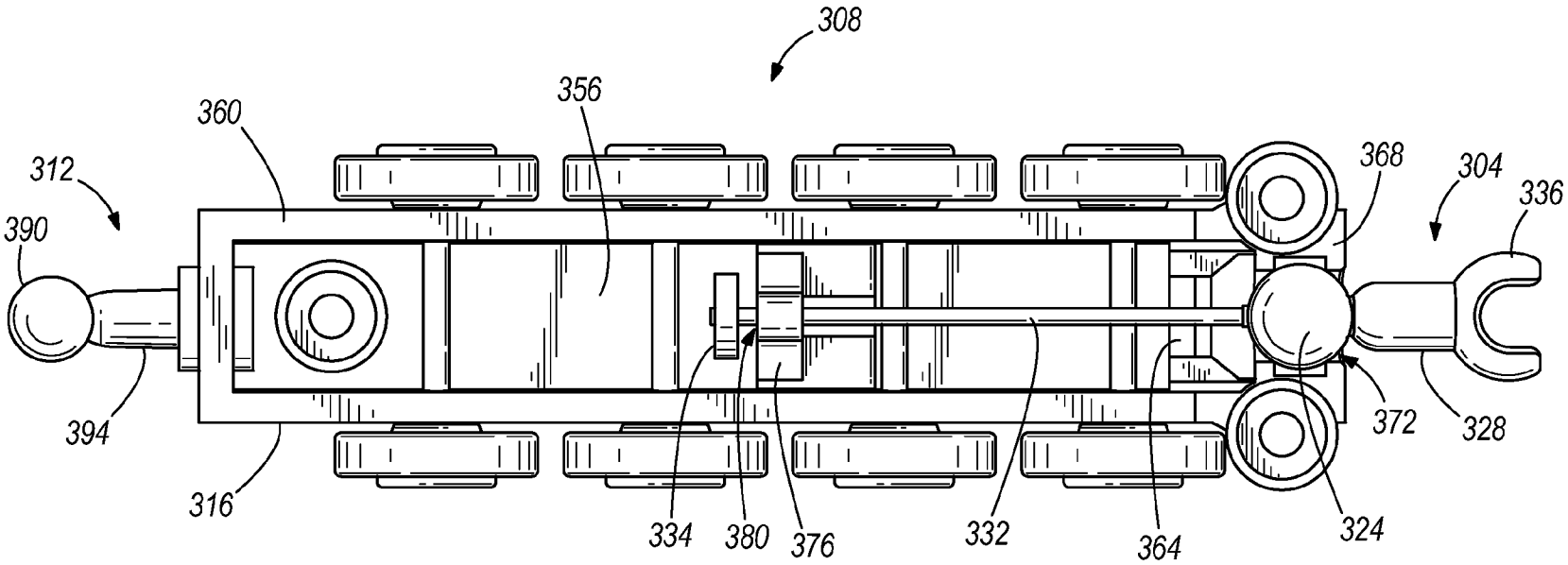
FIG. 7 is a top view of a coupler for a toy car according to an embodiment of the present invention.
Figure 8:
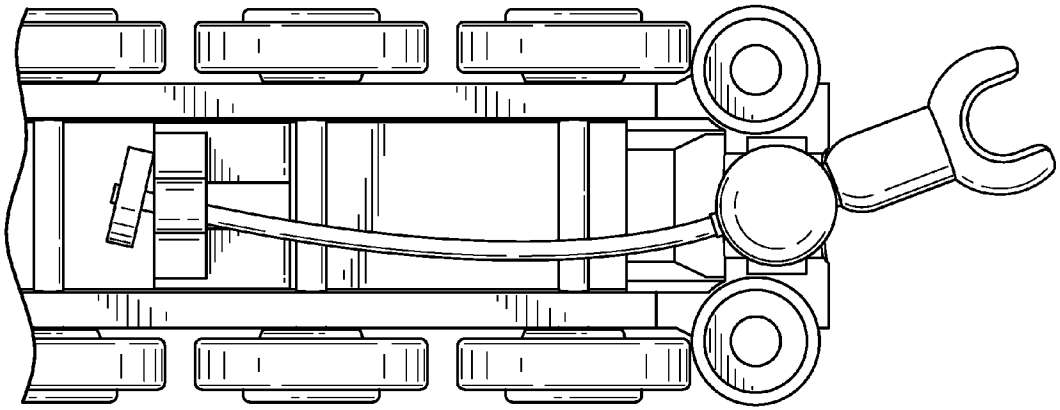
FIG. 8 is a top view of a portion of the coupler illustrated in FIG. 7.

FIGS. 5-6 illustrate a coupler 200 according to one embodiment of the present invention. The coupler 200 includes a first connector 204 (e.g., socket) configured to be connected to a car 208 and a second connector 212 (partially shown) configured to be connected to the car 208. The car 208 can include a frame 216 or base (e.g., chassis) and a body 220 configured to couple to the frame 216. The first connector 204 and/or the second connector 212 can connect to the frame 216 and/or the body 220 and/or be positioned between the frame 216 and the body 220. The first connector 204 can be positioned in the front or rear of the car 208. Similarly, the second connector 212 can be positioned in the front or rear of the car 208. Each car 208 can include a first connector 204 and a second connector 212. The connectors 204, 212 are configured to couple together to link a plurality of cars 208 together.

The first connector 204 includes a ball 224 and a post 228 extending from the ball 224 and a flexible member 232 (e.g., a spring) extending from the ball 224. The post 228 and the flexible member 232 are substantially aligned and extend from the ball 224 opposite one another. The first connector 204 also includes a receptacle 236 extending from the post 228. The post 228 includes a gradually expanding size (e.g., diameter) from a first end (e.g., the ball 224) to a second end (e.g., the receptacle 236). The post 228 can include different shaped cross-sections than illustrated. The receptacle 236 is generally partially spherical-shaped. The receptacle 236 includes a recess 240 and a sidewall 244 configured to receive the second connector 212. The sidewall 244 includes a first notch 248 and a second notch 252 substantially aligned with the first notch 248. In one construction, the first connector 204 is molded as a single piece or component.

The frame 216 of the car 208 includes a floor 256 and a wall 260 extending substantially around the perimeter of the floor 256. The wall 260 includes a gap 264 at a rear of the car 208 and the front of the car 208 to accommodate one of the connectors 204, 212. The frame 216 includes a housing 268 configured to receive the ball 224 of the first connector 204 and allow the ball 224 to rotate. The housing 268 includes openings 272 in a wall to accommodate the post 228 and the flexible member 232.

The frame 216 of the car 208 also includes a bracket 276 having a track 280 configured to receive the flexible member 232. The bracket 276 is configured to be secured to the floor 256 and/or wall 260 of the frame 216 and to maintain the position of the flexible member and to prevent vertical motion of the flexible member 232.

The body 220 of the car 208 includes a wall 284 that at least partially surrounds the wall 260 of the frame 216 when coupled to the frame 216. The wall 284 extends over the opening 272 in the housing 268 to trap the first connector 204 between the frame 216 and the body 220 of the car 208, and also prevents the ball 224 of the first connector 204 from becoming dislodged from the housing 268.

The second connector 212 includes a ball 288 and a post 292 extending from the ball 288. The second connector 212 can include a base 296 configured to be received within the gap 264 in the wall 260 of the frame 216 to secure the second connector 212 to the car 208. In one construction, the second connector 212 is molded as a single piece or component.

The ball 288 is configured to be received within the receptacle 236 to link a first car 208 and a second car 208. The ball 288 also is configured to move within the receptacle 236. As the ball 236 moves within the receptacle 236, the post 292 is configured to be received within the first notch 248 and the second notch 252 to accommodate vertical changes (e.g., hills, loops) between adjacent cars 208 due to the terrain that the cars traverse. Also, the first connector 204 can pivot with respect to the housing 268 to accommodate horizontal changes (e.g., curves, turns) between adjacent cars 208 due to the terrain that the cars traverse. The flexible member 232 is configured to return the first connector 204 to a "neutral" position when not under any force.

When the first connector 204 is coupled to the second connector 212, the post 228 and the post 292 are substantially aligned when the cars 208 are on level terrain. The ball 288 of the second connector 212 pivots in the vertical direction with respect to the first connector 204 as the cars 208 traverse hilly terrain. The coupler 200 accommodates a range of motion in a vertical plane and a horizontal plane. In the vertical plane, the coupler 200 accommodates a range of motion between about 0 degrees and about +90 degrees and between about 0 degrees and about −90 degrees (where 0 degrees is defined when the post 228 and the post 292 are substantially aligned). In the horizontal plane, the coupler 200 accommodates a range of motion between about 0 degrees and about +60 degrees and between about 0 degrees and −60 degrees (where 0 degrees is defined when the post 228 and the post 292 are substantially aligned). The motion in the horizontal plane can include the pivot motion of the ball 224 with respect to the housing 268 or the pivot motion of the ball 288 with respect to the receptacle 236 or a combination thereof.

FIGS. 7-10 illustrate a coupler 300 according to one embodiment of the present invention. The coupler 300 includes a first connector 304 (e.g., socket) configured to be connected to a car 308 and a second connector 312 configured to be connected to the car 308. The car 308 can include a frame 316 or base (e.g., chassis) and a body 320 configured to couple to the frame 316. The first connector 304 and/or the second connector 312 can connect to the frame 316 and/or the body 320 and/or be positioned between the frame 316 and the body 320. The first connector 304 can be positioned in the front or rear of the car 308. Similarly, the second connector 312 can be positioned in the front or rear of the car 308. Each car 308 can include a first connector 304 and a second connector 312. The connectors 304, 312 are configured to couple together to link a plurality of cars 308 together.

Figure 9:
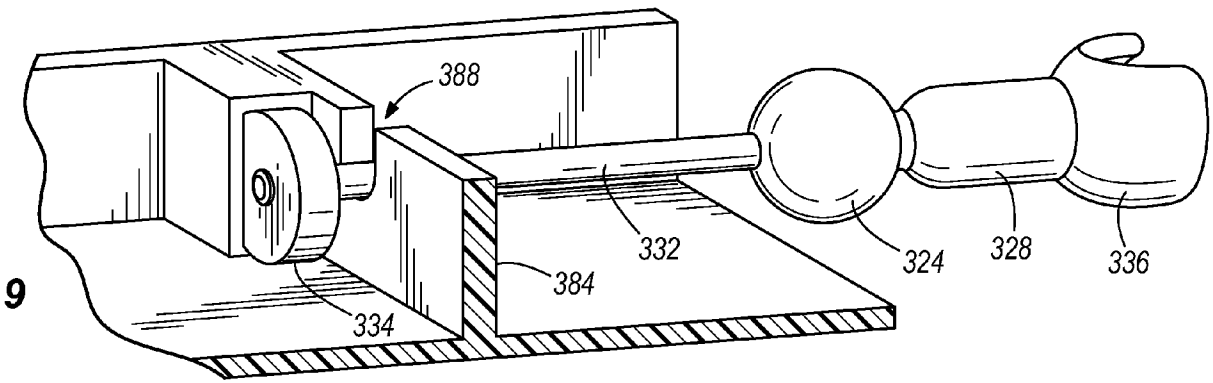
FIG. 9 is a perspective view of a modified portion of the coupler illustrated in FIG. 7.

The first connector 304 includes a ball 324 and a post 328 extending from the ball 324 and a flexible member 332 (e.g., a rod having a small diameter sufficient to be flexible upon application of a force) extending from the ball 324. The flexible member 332 includes a stop 334 at an end opposite the ball 324. The stop 334 can include a disk such as that illustrated in FIG. 10. Alternatively, the stop 334 can include a partially disk-shaped configuration with a flat portion as illustrated in FIG. 9. The post 328 and the flexible member 332 are substantially aligned and extend from the ball 324 opposite one another. The first connector 304 also includes a receptacle 336 extending from the post 328. The post 328 includes a gradually expanding size (e.g., diameter) from a first end (e.g., the ball 324) to a second end (e.g., the receptacle 336). The post 328 can include different shaped cross-sections than illustrated. The receptacle 336 is generally partially spherical-shaped. The receptacle 336 includes a recess 340 and a sidewall 344 configured to receive the second connector 312. The sidewall 344 includes a first notch 348 and a second notch 352 substantially aligned with the first notch 348. In one construction, the first connector 304 is molded as a single piece or component.

The frame 316 of the car 308 includes a floor 356 and a wall 360 extending substantially around the perimeter of the floor 356. The wall 360 includes a gap 364 at a rear of the car 308 and the front of the car 308 to accommodate one of the connectors 304, 312. The frame 316 includes a housing 368 configured to receive the ball 324 of the first connector 304 and allow the ball 324 to rotate. The housing 368 includes openings 372 in a wall to accommodate the post 328 and the flexible member 332.

The frame 316 of the car 308 can include a bracket 376 having a track 380 configured to receive the flexible member 332. The bracket 376 is configured to be secured to the floor 356 and/or wall 360 of the frame 316 or other support member within the frame 316 and to maintain the position of the flexible member 332 and to prevent vertical motion of the flexible member 332. Alternatively, the frame 316 can include a support member 384 or stanchion having a track 388 configured to receive the flexible member 332. The support member 384 can extend substantially perpendicularly from the floor 356.

The body 320 of the car 308 includes a wall 392 that at least partially surrounds the wall 360 of the frame 316 when coupled to the frame 316. The wall 392 extends over the opening 372 in the housing 368 to trap the first connector 304 between the frame 316 and the body 320 of the car 308, and also prevents the ball 324 of the first connector 304 from becoming dislodged from the housing 368.

Figure 10:
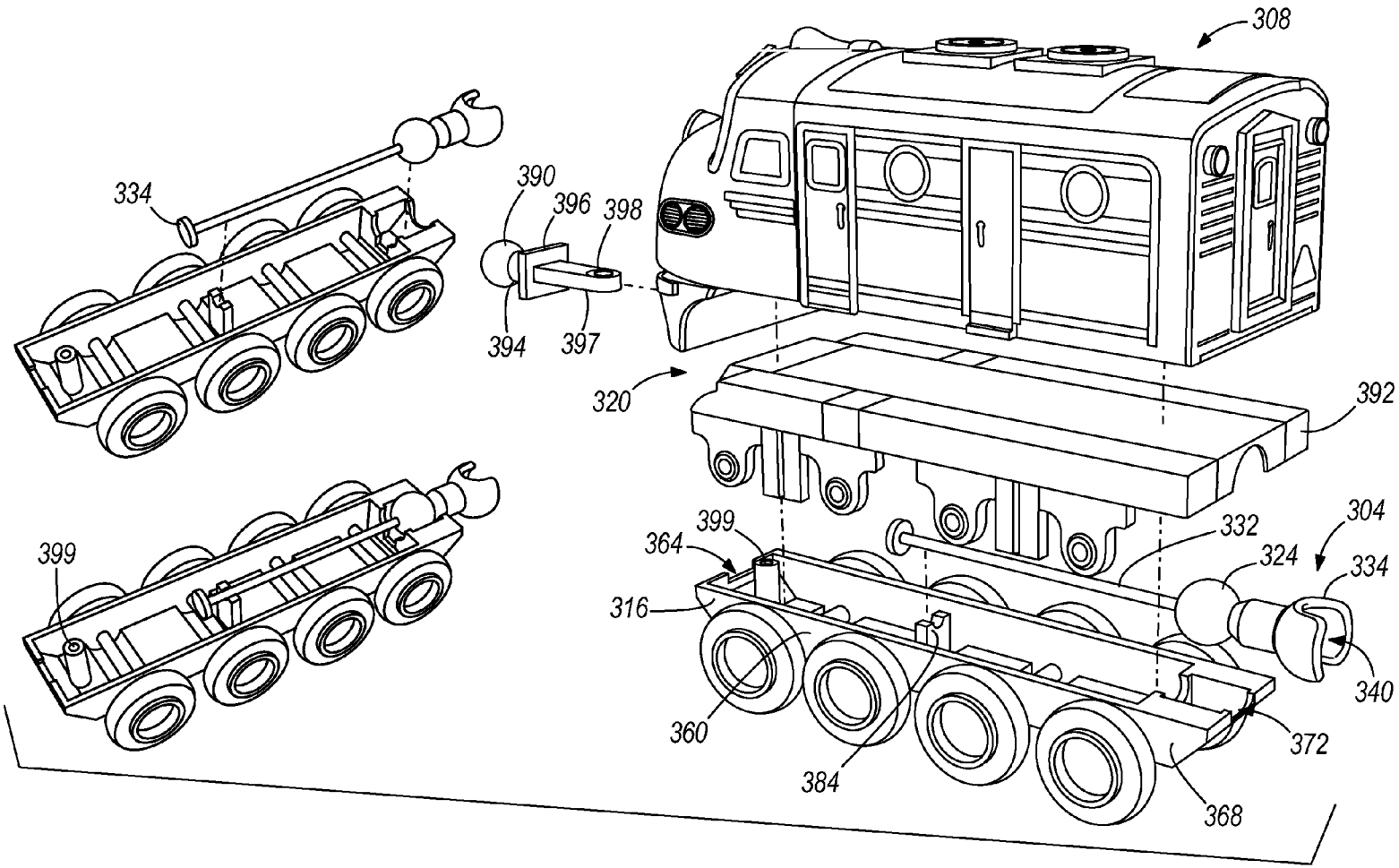
FIG. 10 illustrates a plurality of views of a modified coupler illustrated in FIG. 7.
Figure 11:
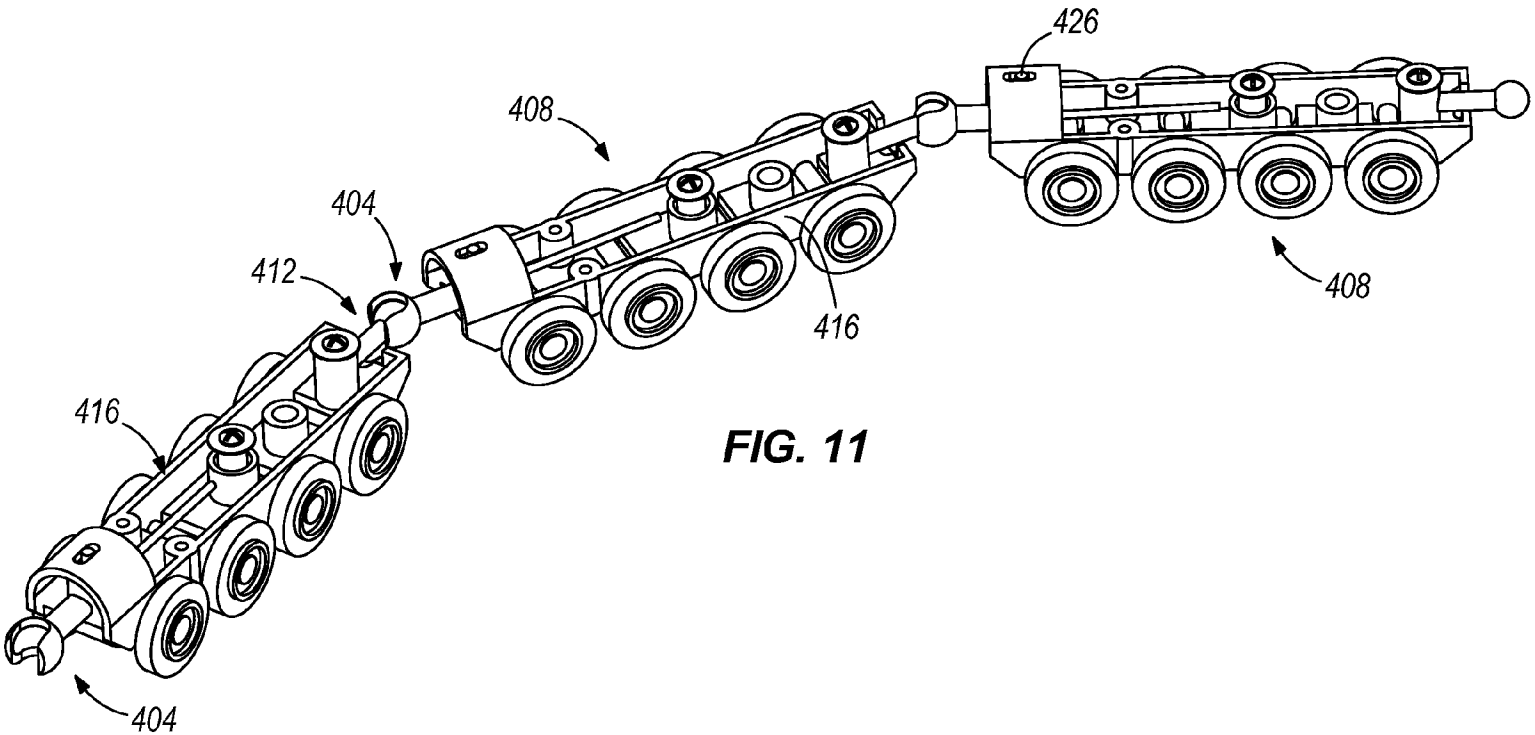
FIG. 11 is a perspective view of a coupler for a toy car according to an embodiment of the present invention.
Figure 12:
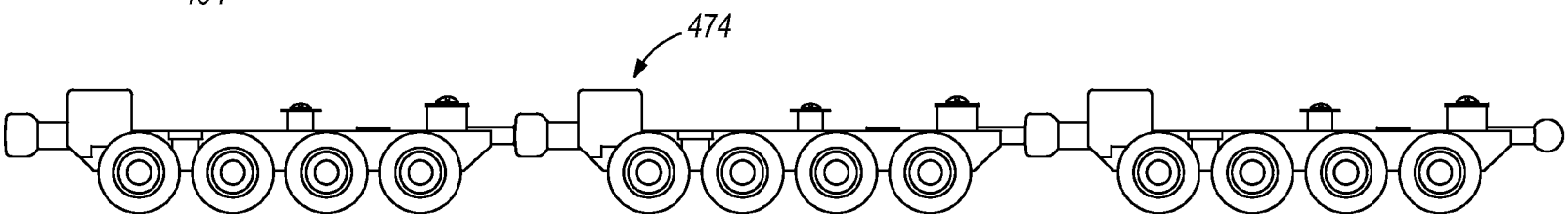
FIG. 12 is a side view of the coupler illustrated in FIG. 11.
Figure 13:
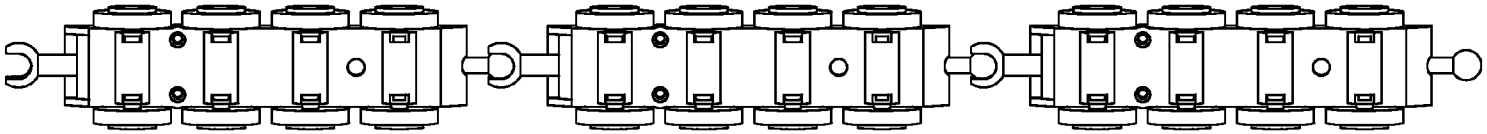
FIG. 13 is a bottom view of the coupler illustrated in FIG. 11.
Figure 14:
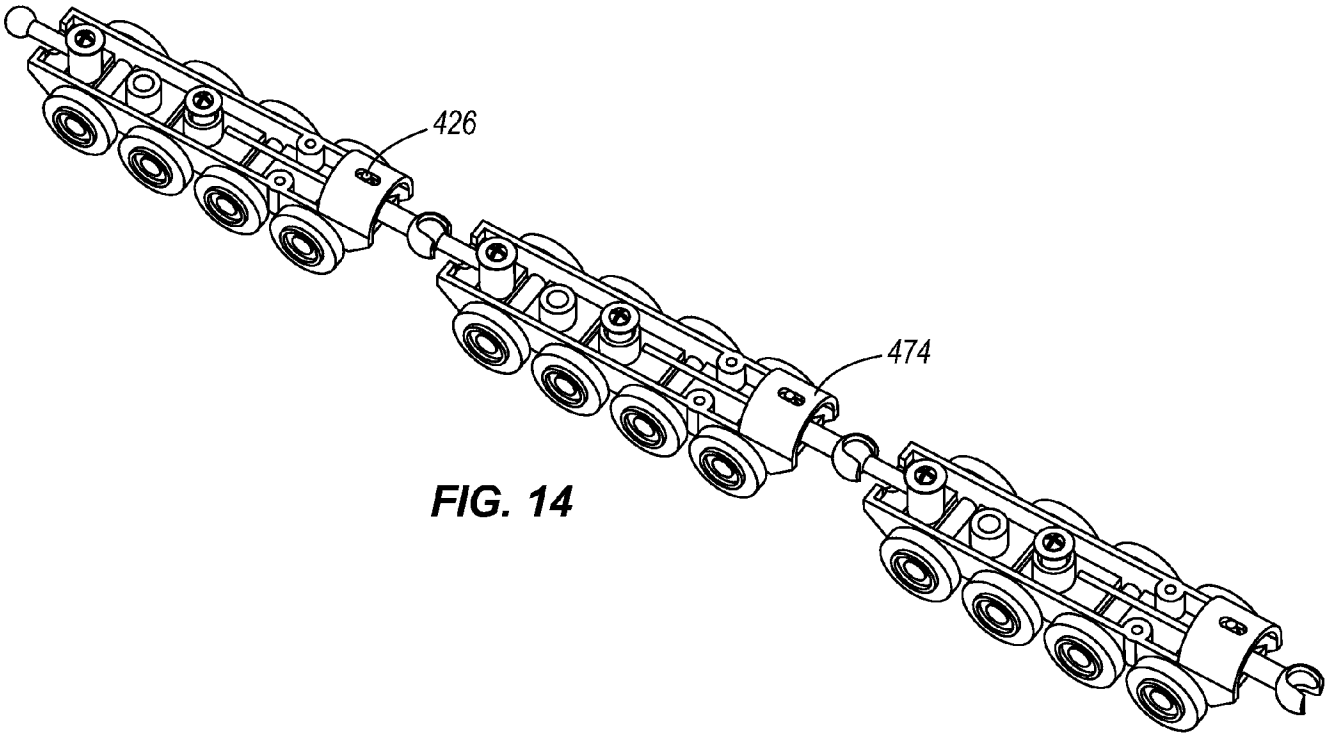
FIG. 14 is a perspective view of the coupler illustrated in FIG. 11.
Figure 15:
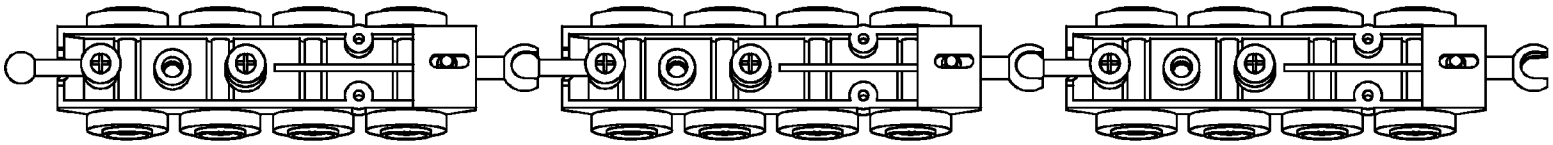
FIG. 15 is a top view of the coupler illustrated in FIG. 11.
Figure 16:
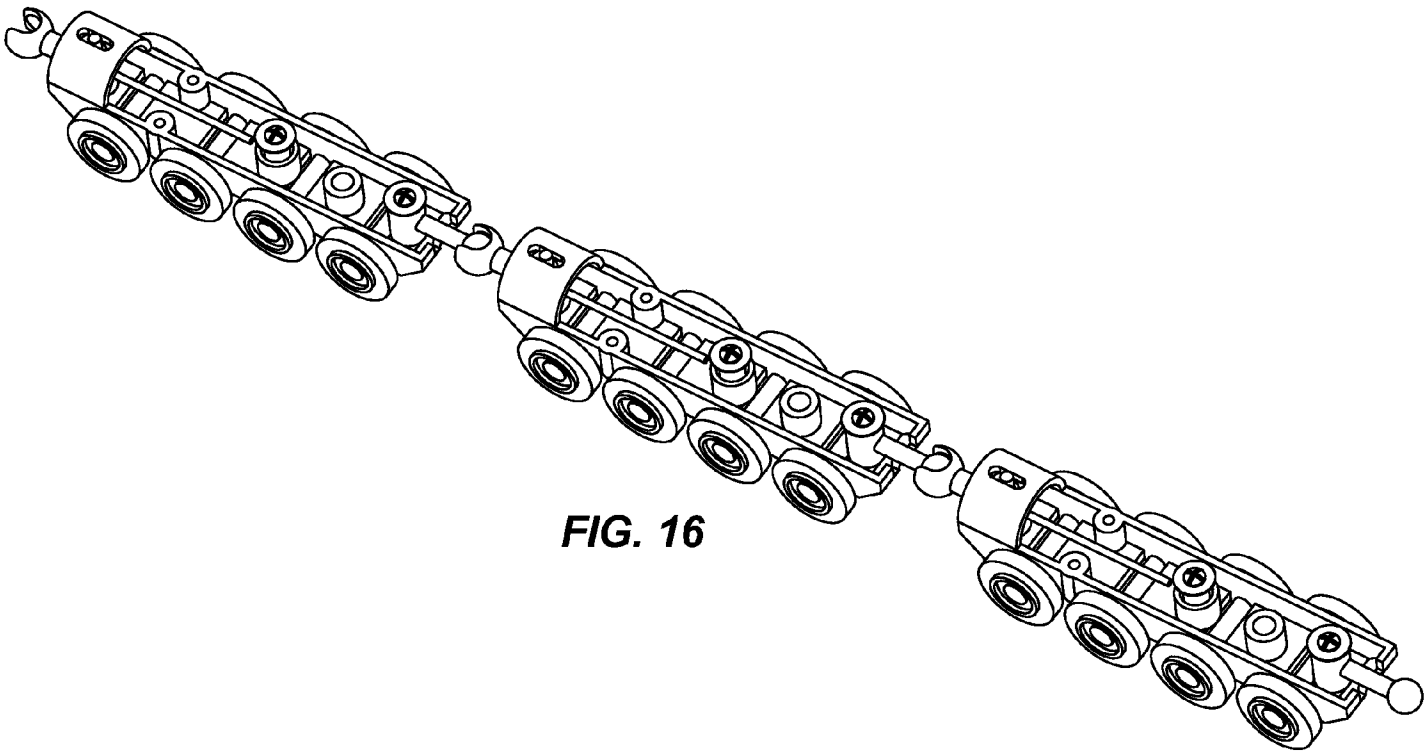
FIG. 16 is a perspective view of the coupler illustrated in FIG. 11.
Figure 17:
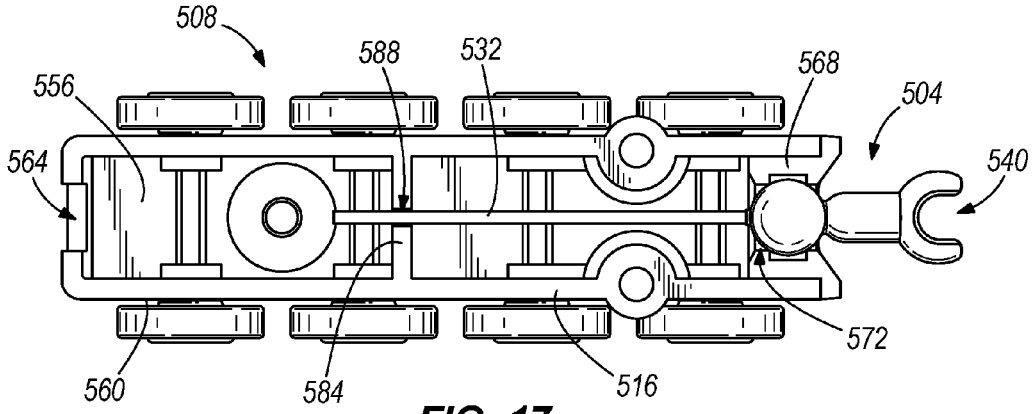
FIG. 17 is a top view of a coupler for a toy car according to an embodiment of the present invention.
Figure 18A:
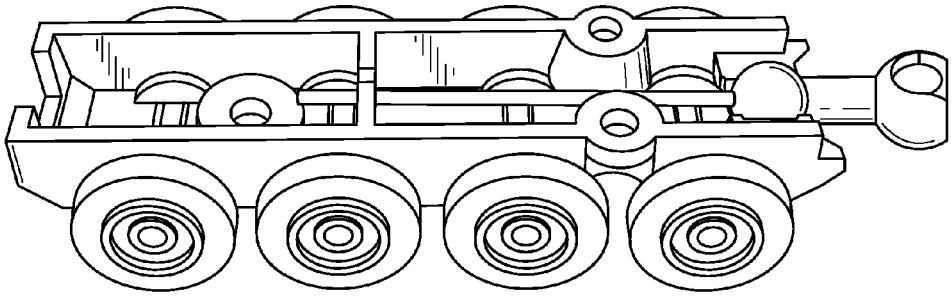
FIGS. 18A-B is a perspective view of the coupler illustrated in FIG. 17.
Figure 18B:
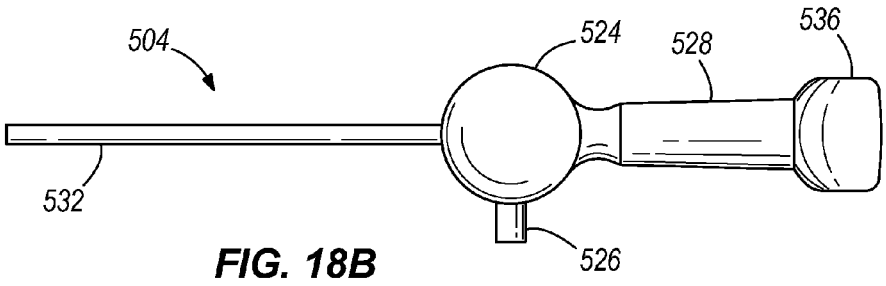

The second connector 312 includes a ball 390 and a post 394 extending from the ball 390. As illustrated in FIG. 10, the second connector 312 can include a base 396 configured to be received within the gap 364 in the wall 360 of the frame 316 to secure the second connector 312 to the car 308. With further reference to FIG. 10, the second connector 312 can include an extension 397 having an opening 398 configured to receive a post 399 supported by the frame 316. In one construction, the second connector 312 is molded as a single piece or component.

The ball 390 is configured to be received within the receptacle 336 to link a first car 308 and a second car 308. The ball 390 also is configured to move within the receptacle 336. As the ball 390 moves within the receptacle 336, the post 394 is configured to be received within the first notch 348 and the second notch 352 to accommodate vertical changes (e.g., hills, loops) between adjacent cars 308 due to the terrain that the cars traverse. Also, the first connector 304 can pivot with respect to the housing 368 to accommodate horizontal changes (e.g., curves, turns) between adjacent cars 308 due to the terrain that the cars traverse. The flexible member 332 is configured to return the first connector 304 to a "neutral" position when not under any force.

When the first connector 304 is coupled to the second connector 312, the post 328 and the post 394 are substantially aligned when the cars 308 are on level terrain. The ball 390 of the second connector 312 pivots in the vertical direction with respect to the first connector 304 as the cars 308 traverse hilly terrain. The coupler 300 accommodates a range of motion in a vertical plane and a horizontal plane. In the vertical plane, the coupler 300 can accommodate a range of motion between about 0 degrees and about +90 degrees and between about 0 degrees and about −90 degrees (where 0 degrees is defined when the post 328 and the post 394 are substantially aligned). In the horizontal plane, the coupler 300 accommodates a range of motion between about 0 degrees and about +60 degrees and between about 0 degrees and −60 degrees (where 0 degrees is defined when the post 328 and the post 394 are substantially aligned). The motion in the horizontal plane can include the pivot motion of the ball 324 with respect to the housing 368 or the pivot motion of the ball 390 with respect to the receptacle 336 or a combination thereof.

FIGS. 11-16 illustrate a coupler 400 according to one embodiment of the present invention. The coupler 400 includes a first connector 404 (e.g., socket) configured to be connected to a car 408 and a second connector 412 configured to be connected to the car 408. The car 408 can include a frame 416 or base (e.g., chassis) and a body 420 configured to couple to the frame 416. The first connector 404 and/or the second connector 412 can connect to the frame 416 and/or the body 420 and/or be positioned between the frame 416 and the body 420. The first connector 404 can be positioned in the front or rear of the car 408. Similarly, the second connector 412 can be positioned in the front or rear of the car 408. Each car 408 can include a first connector 404 and a second connector 412. The connectors 404, 412 are configured to couple together to link a plurality of cars 408 together.

The first connector 404 is similar to the first connector 304 described above and includes a ball 424 and an extension 426 extending therefrom. The first connector 404 also includes a post 428 extending from the ball 424 and a flexible member 432 (e.g., a rod having a small diameter sufficient to be flexible upon application of a force) extending from the ball 424. The flexible member 432 can include a stop 434 at an end opposite the ball 424. The stop 434 can include a disk such as that illustrated in FIG. 10. Alternatively, the stop 434 can include a partially disk-shaped configuration with a flat portion as illustrated in FIG. 9. The post 428 and the flexible member 432 are substantially aligned and extend from the ball 424 opposite one another. The first connector 404 also includes a receptacle 436 extending from the post 428. The post 428 includes a gradually expanding size (e.g., diameter) from a first end (e.g., the ball 424) to a second end (e.g., the receptacle 436). The post 428 can include different shaped cross-sections than illustrated. The receptacle 436 is generally partially spherical-shaped. The receptacle 436 includes a recess 440 and a sidewall 444 configured to receive the second connector 412. The sidewall 444 includes a first notch 448 and a second notch 452 substantially aligned with the first notch 448. In one construction, the first connector 404 is molded as a single piece or component.

The frame 416 of the car 408 includes a floor 456 and a wall 460 extending substantially around the perimeter of the floor 456. The wall 460 includes a gap 464 at a rear of the car 408 and the front of the car 408 to accommodate one of the connectors 404, 412. The frame 416 includes a housing 468 configured to receive the ball 424 of the first connector 404. The housing 468 includes a lower portion 470 and an upper portion 474. The lower portion 470 includes a recess configured to receive the ball 424, and the upper portion 474 includes a recess configured to receive the ball 424. The upper portion 474 also includes a channel 478 configured to receive the extension 426 of the ball 424 to prevent rotation of the ball 424 and to maintain substantial vertical alignment of the first notch 448 and the second notch 452. The housing 468 includes openings 472 in a wall to accommodate the post 428 and the flexible member 432.

The frame 416 of the car 408 can include a bracket 476 having a track 480 configured to receive the flexible member 432. The bracket 476 is configured to be secured to the floor 456 and/or wall 460 of the frame 416 or other support member within the frame 416 and to maintain the position of the flexible member 432 and to prevent vertical motion of the flexible member 432. Alternatively, the frame 416 can include a support member 484 or stanchion having a track 488 configured to receive the flexible member 432. The support member 484 can extend substantially perpendicularly from the floor 456.

The body 420 of the car 408 includes a wall 492 that at least partially surrounds the wall 460 of the frame 416 when coupled to the frame 416. The wall 492 extends over the opening 472 in the housing 468 to trap the first connector 404 between the frame 416 and the body 420 of the car 408, and also prevents the ball 424 of the first connector 404 from becoming dislodged from the housing 468.

The second connector 412 includes a ball 490 and a post 494 extending from the ball 490. The second connector 412 can include a base 496 configured to be received within the gap 464 in the wall 460 of the frame 416 to secure the second connector 412 to the car 408. With further reference to FIG. 10, the second connector 412 can include an extension 497 having an opening 498 configured to receive a post 499 supported by the frame 416. Alternatively, the opening 498 can be configured to receive a fastener to secure the second connector 412 to the frame 416. In one construction, the second connector 412 is molded as a single piece or component.

The ball 490 is configured to be received within the receptacle 436 to link a first car 408 and a second car 408. The ball 490 also is configured to move within the receptacle 436. As the ball 490 moves within the receptacle 436, the post 494 is configured to be received within the first notch 448 and the second notch 452 to accommodate vertical changes (e.g., hills, loops) between adjacent cars 408 due to the terrain that the cars traverse. Also, the first connector 404 can pivot with respect to the housing 468 to accommodate horizontal changes (e.g., curves, turns) between adjacent cars 408 due to the terrain that the cars traverse. The flexible member 432 is configured to return the first connector 404 to a "neutral" position when not under any force.

When the first connector 404 is coupled to the second connector 412, the post 428 and the post 494 are substantially aligned when the cars 408 are on level terrain. The ball 490 of the second connector 412 pivots in the vertical direction with respect to the first connector 404 as the cars 408 traverse hilly terrain. The coupler 400 accommodates a range of motion in a vertical plane and a horizontal plane. In the vertical plane, the coupler 400 can accommodate a range of motion between about 0 degrees and about +90 degrees and between about 0 degrees and about −90 degrees (where 0 degrees is defined when the post 428 and the post 494 are substantially aligned). In the horizontal plane, the coupler 400 accommodates a range of motion between about 0 degrees and about +60 degrees and between about 0 degrees and −60 degrees (where 0 degrees is defined when the post 428 and the post 494 are substantially aligned). The motion in the horizontal plane can include the pivot motion of the ball 424 with respect to the housing 468 or the pivot motion of the ball 490 with respect to the receptacle 436 or a combination thereof.

FIGS. 17-21 illustrate a coupler 500 according to one embodiment of the present invention. The coupler 500 includes a first connector 504 (e.g., socket) configured to be connected to a car 508 and a second connector 512 configured to be connected to the car 508. The car 508 can include a frame 516 or base (e.g., chassis) and a body 520 configured to couple to the frame 516. The first connector 504 and/or the second connector 512 can connect to the frame 516 and/or the body 520 and/or be positioned between the frame 516 and the body 520. The first connector 504 can be positioned in the front or rear of the car 508. Similarly, the second connector 512 can be positioned in the front or rear of the car 508. Each car 508 can include a first connector 504 and a second connector 512. The connectors 504, 512 are configured to couple together to link a plurality of cars 508 together.

The first connector 504 is similar to the first connector 404 described above and includes a ball 524 and an extension 526 extending therefrom. The first connector 504 also includes a post 528 extending from the ball 524 and a flexible member 532 (e.g., a rod having a small diameter sufficient to be flexible upon application of a force) extending from the ball 524. The flexible member 532 can include a stop 534 at an end opposite the ball 524. The stop 534 can include a disk such as that illustrated in FIG. 10. Alternatively, the stop 534 can include a partially disk-shaped configuration with a flat portion as illustrated in FIG. 9. The post 528 and the flexible member 532 are substantially aligned and extend from the ball 524 opposite one another. The first connector 504 also includes a receptacle 536 extending from the post 528. The post 528 includes a gradually expanding size (e.g., diameter) from a first end (e.g., the ball 524) to a second end (e.g., the receptacle 536). The post 528 can include different shaped cross-sections than illustrated. The receptacle 536 is generally partially spherical-shaped. The receptacle 536 includes a recess 540 and a sidewall 544 configured to receive the second connector 512. The sidewall 544 includes a first notch 548 and a second notch 552 substantially aligned with the first notch 548. In one construction, the first connector 504 is molded as a single piece or component.

The frame 516 of the car 508 includes a floor 556 and a wall 560 extending substantially around the perimeter of the floor 556. The wall 560 includes a gap 564 at a rear of the car 508 and the front of the car 508 to accommodate one of the connectors 504, 512. The frame 516 includes a housing 568 configured to receive the ball 524 of the first connector 504. The housing 568 includes a lower portion 570 and an upper portion 574. The lower portion 570 includes a recess configured to receive the ball 524, and the upper portion 574 includes a recess configured to receive the ball 524. The lower portion 570 includes a channel 578 configured to receive the extension 526 of the ball 524 to prevent rotation of the ball 524 and to maintain substantial vertical alignment of the first notch 548 and the second notch 552. The housing 568 includes openings 572 in a wall to accommodate the post 528 and the flexible member 532.

The frame 516 of the car 508 can include a bracket 576 having a track 580 configured to receive the flexible member 532. The bracket 576 is configured to be secured to the floor 556 and/or wall 560 of the frame 516 or other support member within the frame 516 and to maintain the position of the flexible member 532 and to prevent vertical motion of the flexible member 532. Alternatively, the frame 516 can include a support member 584 or stanchion having a track 588 configured to receive the flexible member 532. The support member 584 can extend substantially perpendicularly from the floor 556.

The body 520 of the car 508 includes a wall 592 that at least partially surrounds the wall 560 of the frame 516 when coupled to the frame 516. The wall 592 extends over the wall 560 to trap the first connector 504 between the frame 516 and the body 520 of the car 508, and also prevents the ball 524 of the first connector 504 from becoming dislodged from the housing 568.

Figure 20:
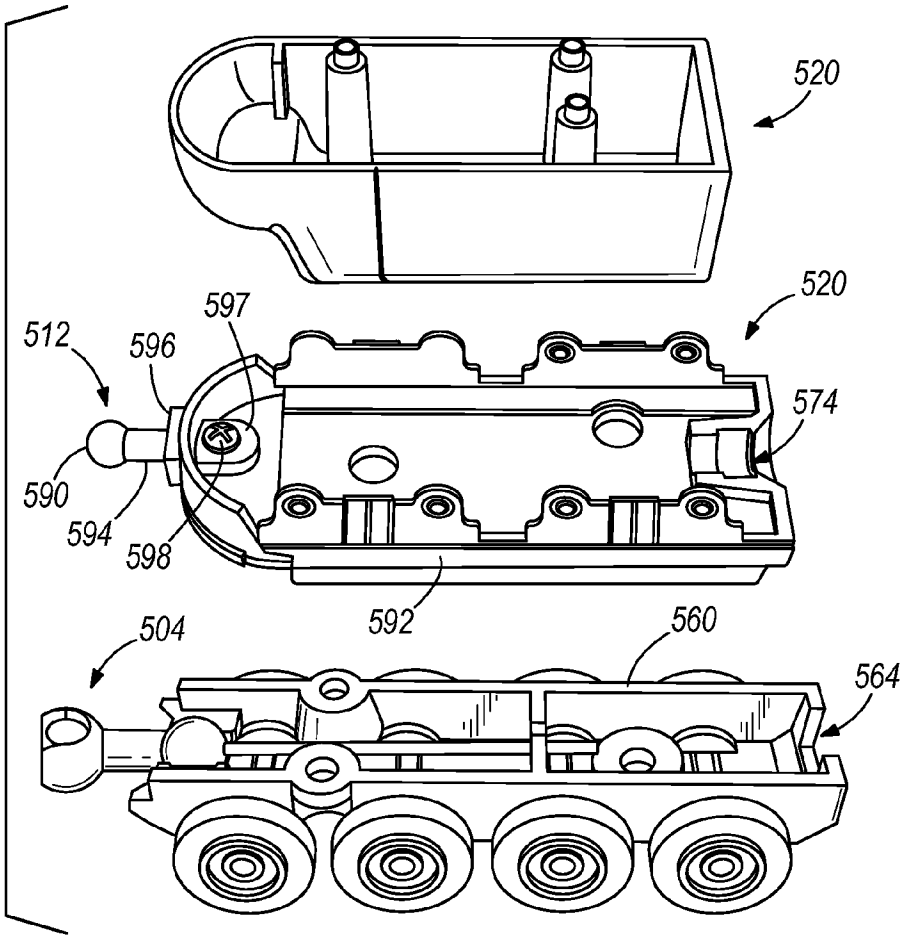
FIG. 20 is an assembly view of the coupler illustrated in FIG. 17.
Figure 19:
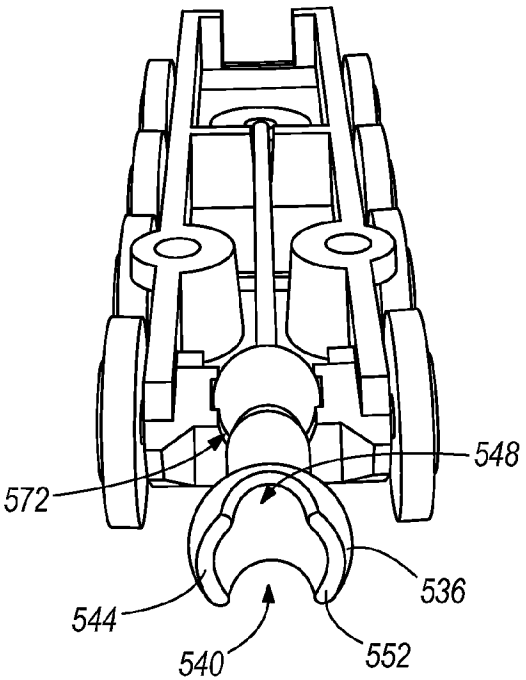
FIG. 19 is a front perspective view of the coupler illustrated in FIG. 17
Figure 21:
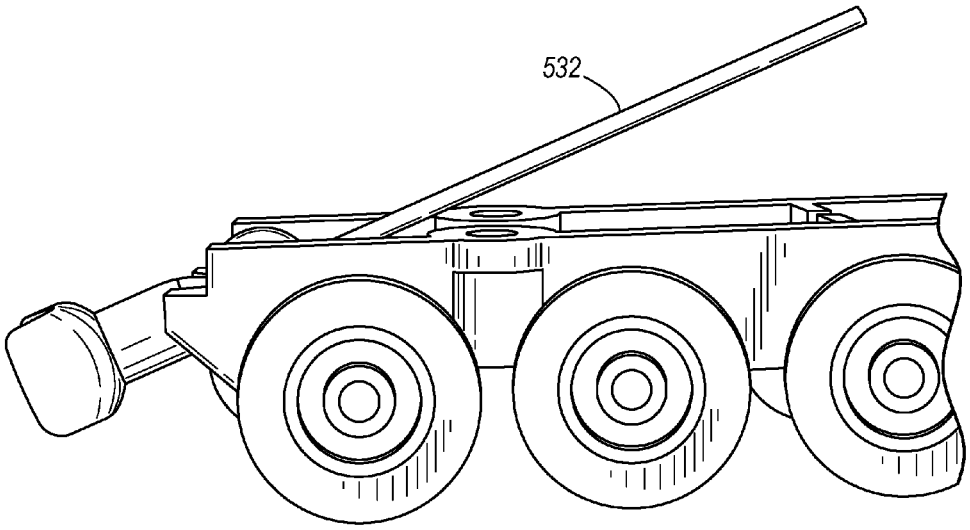
FIG. 21 is a side view of the coupler illustrated in FIG. 17.

The second connector 512 includes a ball 590 and a post 594 extending from the ball 590. The second connector 512 can include a base 596 configured to be received within the gap 564 in the wall 560 of the frame 516 to secure the second connector 512 to the car 508. With further reference to FIG. 20, the second connector 512 can include an extension 597 having an opening 598 configured to receive a post 599 supported by the frame 516. Alternatively, the opening 598 can be configured to receive a fastener to secure the second connector 512 to the frame 516. In one construction, the second connector 512 is molded as a single piece or component.

The ball 590 is configured to be received within the receptacle 536 to link a first car 508 and a second car 508. The ball 590 also is configured to move within the receptacle 536. As the ball 590 moves within the receptacle 536, the post 594 is configured to be received within the first notch 548 and the second notch 552 to accommodate vertical changes (e.g., hills, loops) between adjacent cars 508 due to the terrain that the cars traverse. Also, the first connector 404 can pivot with respect to the housing 568 to accommodate horizontal changes (e.g., curves, turns) between adjacent cars 508 due to the terrain that the cars traverse. The flexible member 532 is configured to return the first connector 504 to a "neutral" position when not under any force.

When the first connector 504 is coupled to the second connector 512, the post 528 and the post 594 are substantially aligned when the cars 508 are on level terrain. The ball 590 of the second connector 512 pivots in the vertical direction with respect to the first connector 504 as the cars 508 traverse hilly terrain. The coupler 500 accommodates a range of motion in a vertical plane and a horizontal plane. In the vertical plane, the coupler 500 can accommodate a range of motion between about 0 degrees and about +90 degrees and between about 0 degrees and about −90 degrees (where 0 degrees is defined when the post 528 and the post 594 are substantially aligned). In the horizontal plane, the coupler 500 accommodates a range of motion between about 0 degrees and about +60 degrees and between about 0 degrees and −60 degrees (where 0 degrees is defined when the post 528 and the post 594 are substantially aligned). The motion in the horizontal plane can include the pivot motion of the ball 524 with respect to the housing 568 or the pivot motion of the ball 590 with respect to the receptacle 536 or a combination thereof.

Various features and advantages of the invention are set forth in the following claims.

What is claimed is:

1. A train car comprising:

a main base including a floor including a first end and a second end opposite the first end, a wall extending substantially perpendicular from the floor and around a periphery of the floor, a first gap in the wall at the first end, a second gap in the wall at the second end, and a post positioned within the second gap and extending substantially perpendicular from the floor;

a first connector including a post having a first end and a second end, at least a portion of the post configured to be received within the first gap, the first end of the post configured to protrude from the wall of the base, a ball secured to the first end, a first base positioned between the first end and the second end of the post, the first base configured to be received within the first gap, the first base including a first surface positioned substantially flush with an outer surface of the wall of the base, a second base secured to the second end of the post, the second base positioned inside the wall of the base;

a second connector including a post having a first end and a second end, a hollow base secured to the first end, the hollow base configured to receive the post extending from the floor of the base, a receptacle secured to the second end, the receptacle configured to receive a ball from a complementary train car; and a body including an outer wall configured to receive the wall of the main base and configured to trap the first connector and the second connector in their respective positions.

2. The train car of claim 1 wherein the ball from the complementary train car is configured to move within the receptacle.

3. The train car of claim 1 wherein the receptacle of the second connector includes a first notch and a second notch configured to accommodate vertical movement of the complementary train car with respect to the main body.

4. The train car of claim 1 wherein the second connector is configured to pivot with respect to the post extending from the floor of the main base.

5. The train car of claim 1 wherein the second base of the first connector includes a surface in contact with an inner surface of the wall of the main base.

6. The train car of claim 1 wherein the post, the hollow base, and the receptacle of the second connector are integrally molded as a single component.

7. The train car of claim 1 wherein the post, the ball, the first base, and the second base of the first connector are integrally molded as a single component.

8. A train car comprising:

a main base including a floor including a first end and a second end opposite the first end, a housing connected to the second end;

a first connector positioned at the first end of the floor of the main base; and a second connector including a receptacle configured to receive the first connector of a complementary train car, a post extending from the receptacle, a ball connected to the post, the ball configured to rest within the housing, and a flexible member extending from the ball and substantially opposite to the post, the flexible member at least partially positioned within the housing and at least partially positioned within a periphery of the floor.

9. The train car of claim 8 wherein the flexible member is a spring.

10. The train car of claim 8 wherein the post and the flexible member include longitudinal axes that are substantially aligned.

11. The train car of claim 8 wherein the bracket is configured to be secured to the floor of the main base and to maintain the position of the flexible member.

12. The train car of claim 8 wherein the receptacle of the second connector includes a first notch and a second notch configured to accommodate vertical movement of the complementary train car with respect to the main body.

13. The train car of claim 8 wherein the first connector from the complementary train car is configured to move within the receptacle.

14. The train car of claim 8 wherein the receptacle of the second connector is configured to move laterally with respect to the main base.

15. The train car of claim 8 further comprising a bracket having a track configured to receive the flexible member, and wherein the bracket is connected to the main base.

16. The train car of claim 15 wherein the bracket is configured to extend over the flexible member.

17. The train car of claim 8 further comprising a stop connected to a distal end of the flexible member.

* * * * *